US009030120B2

(12) United States Patent
Pickard et al.

(10) Patent No.: US 9,030,120 B2
(45) Date of Patent: May 12, 2015

(54) HEAT SINKS AND LAMP INCORPORATING SAME

(75) Inventors: Paul Kenneth Pickard, Morrisville, NC (US); Gerald H. Negley, Durham, NC (US); Antony Paul Van De Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 633 days.

(21) Appl. No.: 12/607,355

(22) Filed: Oct. 28, 2009

(65) Prior Publication Data

US 2011/0089838 A1 Apr. 21, 2011

Related U.S. Application Data

(63) Continuation-in-part of application No. 12/582,206, filed on Oct. 20, 2009.

(51) Int. Cl.

| | |
|---|---|
| ***H05B 37/02*** | (2006.01) |
| ***F21K 99/00*** | (2010.01) |
| ***F21V 29/00*** | (2006.01) |
| *F21Y 101/02* | (2006.01) |

(Continued)

(52) U.S. Cl.

CPC ..... *F21K 9/135* (2013.01); *F21Y 2101/02* (2013.01); *F28D 2021/0029* (2013.01); *F28F 1/40* (2013.01); *F28F 3/048* (2013.01); *F21Y 2105/003* (2013.01); *F21Y 2111/005* (2013.01); *F21V 29/2225* (2013.01); *F21V 29/225* (2013.01); *F21V 29/2293* (2013.01); *F21V 29/262* (2013.01); *F21V 29/027* (2013.01)

(58) Field of Classification Search

CPC . F21V 29/2225; F21V 29/225; F21V 29/262; F21V 29/2293; F21K 9/135; H05B 37/02; H05B 33/0881

USPC ..... 315/113, 32, 291, 45; 362/227, 230, 362/249.02, 294, 296.02

See application file for complete search history.

(56) References Cited

U.S. PATENT DOCUMENTS

| | | | |
|---|---|---|---|
| 3,755,697 | A | 8/1973 | Miller |
| 3,787,752 | A | 1/1974 | Delay |

(Continued)

FOREIGN PATENT DOCUMENTS

| | | |
|---|---|---|
| CN | 101666439 | 3/2010 |
| DE | 10 2007 040 444 | 3/2009 |

(Continued)

OTHER PUBLICATIONS

U.S. Appl. No. 12/411,905, filed Mar. 26, 2009, Van de Ven.

(Continued)

*Primary Examiner* — Jimmy Vu
*Assistant Examiner* — Amy Yang
(74) *Attorney, Agent, or Firm* — Burr & Brown, PLLC

(57) ABSTRACT

A lamp comprising a solid state light emitter, the lamp being an A lamp and providing a wall plug efficiency of at least 90 lumens per watt. Also, a lamp comprising a solid state light emitter and a power supply, the emitter being mounted on a heat dissipation element, the dissipation element being spaced from the power supply. Also, a lamp, comprising a solid state light emitter and a heat dissipation element that has a heat dissipation chamber, whereby an ambient medium can enter the chamber, pass through the chamber, and exit. Also, a lamp, comprising a light emissive housing at least one solid state lighting emitter and a first heat dissipation element.

16 Claims, 14 Drawing Sheets

(51) Int. Cl.

| | |
|---|---|
| *F28D 21/00* | (2006.01) |
| *F28F 1/40* | (2006.01) |
| *F28F 3/04* | (2006.01) |
| *F21Y 105/00* | (2006.01) |
| *F21Y 111/00* | (2006.01) |
| *F21V 29/02* | (2006.01) |

(56) References Cited

U.S. PATENT DOCUMENTS

| | | | | |
|---|---|---|---|---|
| 4,090,189 | A | 5/1978 | Fisler | |
| 4,717,868 | A | 1/1988 | Peterson | |
| 4,918,487 | A | 4/1990 | Coulter, Jr. | |
| 5,151,679 | A | 9/1992 | Dimmick | |
| 5,175,528 | A | 12/1992 | Choi et al. | |
| 5,191,512 | A | 3/1993 | Ogura et al. | |
| 5,345,167 | A | 9/1994 | Hasegawa et al. | |
| 5,631,190 | A | 5/1997 | Negley | |
| 5,661,645 | A | 8/1997 | Hochstein | |
| 5,736,881 | A | 4/1998 | Ortiz | |
| 5,844,377 | A | 12/1998 | Anderson et al. | |
| 5,890,794 | A | 4/1999 | Abtahi et al. | |
| 5,912,477 | A | 6/1999 | Negley | |
| 5,912,568 | A | 6/1999 | Kiley | |
| 5,946,931 | A | 9/1999 | Lomax et al. | |
| 6,150,771 | A | 11/2000 | Perry | |
| 6,161,910 | A | 12/2000 | Reisenauer et al. | |
| 6,222,172 | B1 | 4/2001 | Fossum et al. | |
| 6,285,139 | B1 | 9/2001 | Ghanem | |
| 6,329,760 | B1 | 12/2001 | Bebenroth | |
| 6,340,868 | B1 | 1/2002 | Lys et al. | |
| 6,353,295 | B1 | 3/2002 | Sridhar et al. | |
| 6,362,578 | B1 | 3/2002 | Swanson et al. | |
| 6,388,393 | B1 | 5/2002 | Illingworth | |
| 6,400,101 | B1 | 6/2002 | Biebl et al. | |
| 6,528,954 | B1 | 3/2003 | Lys et al. | |
| 6,573,536 | B1 | 6/2003 | Dry | |
| 6,577,072 | B2 | 6/2003 | Saito et al. | |
| 6,586,890 | B2 | 7/2003 | Min et al. | |
| 6,614,358 | B1 | 9/2003 | Hutchison et al. | |
| 6,621,222 | B1 | 9/2003 | Hong | |
| 6,636,003 | B2 | 10/2003 | Rahm et al. | |
| 6,724,376 | B2 | 4/2004 | Sakura et al. | |
| 6,747,420 | B2 | 6/2004 | Barth et al. | |
| 6,808,287 | B2 | 10/2004 | Lebens et al. | |
| 6,815,724 | B2 | 11/2004 | Dry | |
| 6,836,081 | B2 | 12/2004 | Swanson et al. | |
| 6,841,947 | B2 | 1/2005 | Berg-johansen | |
| 6,873,203 | B1 | 3/2005 | Latham, II et al. | |
| 6,948,829 | B2 | 9/2005 | Verdes et al. | |
| 6,987,787 | B1 | 1/2006 | Mick | |
| 6,995,518 | B2 | 2/2006 | Havlik et al. | |
| 7,031,155 | B2 | 4/2006 | Sauciuc et al. | |
| 7,038,399 | B2 | 5/2006 | Lys et al. | |
| 7,071,762 | B2 | 7/2006 | Xu et al. | |
| 7,119,498 | B2 | 10/2006 | Baldwin et al. | |
| 7,144,135 | B2 | 12/2006 | Martin et al. | |
| 7,180,487 | B2 | 2/2007 | Kamikawa et al. | |
| 7,202,608 | B2 | 4/2007 | Robinson et al. | |
| 7,213,940 | B1 | 5/2007 | Van De Ven et al. | |
| 7,245,495 | B2 | 7/2007 | Ouyang | |
| 7,253,446 | B2 | 8/2007 | Sakuma et al. | |
| 7,344,296 | B2 | 3/2008 | Matsui et al. | |
| 7,434,964 | B1 * | 10/2008 | Zheng et al. | 362/294 |
| 7,524,089 | B2 | 4/2009 | Park | |
| 7,534,015 | B2 | 5/2009 | Xu et al. | |
| 7,556,869 | B2 | 7/2009 | Fukushima et al. | |
| 7,611,263 | B2 | 11/2009 | Huang et al. | |
| 7,661,854 | B1 | 2/2010 | Yang et al. | |
| 7,695,162 | B2 | 4/2010 | Zheng et al. | |
| 7,744,250 | B2 | 6/2010 | Lee et al. | |
| D626,257 | S | 10/2010 | Pickard | |
| 7,857,488 | B2 | 12/2010 | Chen et al. | |
| D644,356 | S | 8/2011 | Pickard | |
| 8,066,414 | B2 | 11/2011 | Pabst et al. | |
| 8,104,919 | B2 | 1/2012 | Wung et al. | |
| 8,123,381 | B1 | 2/2012 | Wray | |
| 8,333,487 | B2 | 12/2012 | Mekhtarian | |
| 8,680,754 | B2 | 3/2014 | Premysler | |
| 8,783,910 | B2 | 7/2014 | Hua | |
| 2003/0063462 | A1 * | 4/2003 | Shimizu et al. | 362/230 |
| 2003/0117803 | A1 | 6/2003 | Chen | |
| 2005/0111234 | A1 | 5/2005 | Martin et al. | |
| 2005/0174780 | A1 | 8/2005 | Park | |
| 2005/0200289 | A1 | 9/2005 | Krichtafovitch | |
| 2006/0056113 | A1 | 3/2006 | Fukushima et al. | |
| 2006/0158089 | A1 | 7/2006 | Saito et al. | |
| 2007/0102033 | A1 | 5/2007 | Petrocy | |
| 2007/0137074 | A1 | 6/2007 | Van de Ven | |
| 2007/0139920 | A1 | 6/2007 | Van de Ven | |
| 2007/0139923 | A1 | 6/2007 | Negley | |
| 2007/0170447 | A1 | 7/2007 | Negley | |
| 2007/0171145 | A1 | 7/2007 | Coleman | |
| 2007/0230184 | A1 | 10/2007 | Shuy | |
| 2007/0236911 | A1 | 10/2007 | Negley | |
| 2007/0263393 | A1 | 11/2007 | Van de Ven | |
| 2007/0267983 | A1 | 11/2007 | Van de Ven | |
| 2007/0274063 | A1 | 11/2007 | Negley | |
| 2007/0274080 | A1 | 11/2007 | Negley | |
| 2007/0278503 | A1 | 12/2007 | Van de Ven | |
| 2007/0278934 | A1 | 12/2007 | Van de Ven | |
| 2007/0278974 | A1 | 12/2007 | Van de Ven | |
| 2007/0279440 | A1 | 12/2007 | Negley | |
| 2007/0279903 | A1 | 12/2007 | Negley | |
| 2007/0280624 | A1 | 12/2007 | Negley | |
| 2008/0055909 | A1 | 3/2008 | Li | |
| 2008/0084685 | A1 | 4/2008 | Van de Ven | |
| 2008/0084700 | A1 | 4/2008 | Van de Ven | |
| 2008/0084701 | A1 | 4/2008 | Van de Ven | |
| 2008/0088248 | A1 | 4/2008 | Myers | |
| 2008/0089053 | A1 | 4/2008 | Negley | |
| 2008/0106895 | A1 | 5/2008 | Van de Ven | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0112183 | A1 | 5/2008 | Negley | |
| 2008/0130285 | A1 | 6/2008 | Negley | |
| 2008/0130298 | A1 | 6/2008 | Negley | |
| 2008/0136313 | A1 | 6/2008 | Van de Ven | |
| 2008/0137347 | A1 | 6/2008 | Trott | |
| 2008/0259589 | A1 | 10/2008 | Van de Ven | |
| 2008/0278928 | A1 | 11/2008 | Van de Ven | |
| 2008/0278940 | A1 | 11/2008 | Van de Ven | |
| 2008/0278950 | A1 | 11/2008 | Pickard | |
| 2008/0278952 | A1 | 11/2008 | Trott | |
| 2008/0278957 | A1 | 11/2008 | Pickard | |
| 2008/0304260 | A1 | 12/2008 | Van de Ven | |
| 2008/0304261 | A1 | 12/2008 | Van de Ven | |
| 2008/0304269 | A1 | 12/2008 | Pickard | |
| 2008/0309255 | A1 | 12/2008 | Myers | |
| 2008/0316755 | A1 | 12/2008 | Zheng | |
| 2009/0045933 | A1 | 2/2009 | Smith et al. | |
| 2009/0046473 | A1 | 2/2009 | Tsai et al. | |
| 2009/0059559 | A1 | 3/2009 | Pabst et al. | |
| 2009/0080187 | A1 * | 3/2009 | Chou | 362/231 |
| 2009/0108269 | A1 | 4/2009 | Negley | |
| 2009/0160363 | A1 | 6/2009 | Negley | |
| 2009/0161356 | A1 | 6/2009 | Negley | |
| 2009/0184616 | A1 | 7/2009 | Van de Ven | |
| 2009/0184662 | A1 | 7/2009 | Given | |
| 2009/0184666 | A1 | 7/2009 | Myers | |
| 2009/0190312 | A1 | 7/2009 | Katayama et al. | |
| 2009/0195186 | A1 | 8/2009 | Guest et al. | |
| 2009/0245308 | A1 | 10/2009 | Yu et al. | |
| 2009/0261268 | A1 | 10/2009 | Schwiebert et al. | |
| 2009/0283779 | A1 | 11/2009 | Negley et al. | |
| 2009/0288807 | A1 | 11/2009 | Yang et al. | |
| 2009/0296384 | A1 | 12/2009 | Van de Ven | |
| 2010/0020532 | A1 | 1/2010 | Negley | |
| 2010/0102199 | A1 | 4/2010 | Negley | |
| 2010/0102697 | A1 | 4/2010 | Van de Ven | |
| 2010/0103678 | A1 | 4/2010 | Van de Ven | |
| 2010/0165635 | A1 | 7/2010 | Chen | |
| 2010/0237760 | A1 * | 9/2010 | Yang | 313/46 |

(56) References Cited

U.S. PATENT DOCUMENTS

| | | | | |
|---|---|---|---|---|
| 2010/0277069 | A1* | 11/2010 | Janik et al. | 315/35 |
| 2010/0314985 | A1* | 12/2010 | Premysler | 313/46 |
| 2010/0327725 | A1 | 12/2010 | Huang | |
| 2011/0297361 | A1 | 12/2011 | Carbone et al. | |
| 2012/0075854 | A1 | 3/2012 | Maxik et al. | |
| 2012/0224374 | A1 | 9/2012 | Aliberti | |
| 2013/0208469 | A1 | 8/2013 | Progl | |
| 2014/0340870 | A1 | 11/2014 | Premysler | |

FOREIGN PATENT DOCUMENTS

| | | |
|---|---|---|
| EP | 2 239 493 | 10/2010 |
| JP | 2004-265626 | 9/2004 |
| JP | 2006-083219 | 3/2006 |
| KR | 20100003326 | 1/2010 |
| WO | 2009/073394 | 6/2009 |
| WO | 2009/091562 | 7/2009 |
| WO | 2009/157704 | 12/2009 |

OTHER PUBLICATIONS

U.S. Appl. No. 12/535,319, filed Aug. 4, 2009, Van de Ven.
U.S. Appl. No. 12/476,356, filed Jun. 2, 2009.
Gernert, Nelson, *Active heat sink technology delivers added performance*, Electronic Products, Developments in active heat sink technology, pp. 1-4.
ANSI C78.20-2003, Revision of C78.20-1995, American National Standard for electric lamps- A, G, PS and Similar Shapes with E26 Medium Screw Bases, (Oct. 2003), pp. 1-48.
Computer Cooling, Electronics Cooling, . . . , SynJet® Technology: Overview,www.noventix.com/technology, pp. 1-2.
Cooligy's Active Microchannel Cooling System,www.frostytech.com/articleview.cfm, pp. 1-2.
EE Times, Pin-fin heat sink integrates fan, www.eetimes.com/showarticle.jhtml, (Nov. 2009), pp. 1-2.
Indian origin scientists microchip-sized fan produces enough wind to cool a laptop, thaindian.com/.../indian-origin-scientist . . . , Mar. 19, 2008, pp. 1-2.
LED PARFECTION™, The Perfectly Designed Green Lighting Solution, http//www.litetronics.com/advertising/led-parfection-perfectly-designed.html.
Philips, *Philips First to Submit to Department of Energy L PRIZE$^{SM}$ Competition with Development of LED Replacment for Common Household Bulb*, Philips L PRIZE$^{SM}$ Press Information, Sep. 24, 2009, pp. 1-3.
Coyne et al., *Giant Magnetoresistance: The Really Big Idea Behind a Very Tiny Tool*, Magnet Lab, www.magnet.fsu.edu/education/.../gmr/, pp. 1-4.
Dan Schlitz, *Dan Schlitz of Thorrn Micro Technologies, Inc., Describes Innovative Micro-fan Technology*, National Science Foundation, Press Release 08-041-Video, nsf.gov/news/news_videos.jsp?cntn_id . . . , pp. 1.
Nuventix, *Cooling LEDs is no longer a design obstacle*, Dual DLM Brochure, www.nuventix.com/led_cooling, pp. 1-4.
Nuventix, *SynJet® PAR20 LED Cooler with Heat Sink*, Design Guide, Version 1.0, Jul. 2009, pp. 1-33.
Piezo Fans, *PiezoFans, LLC brings the latest piezoelectric technology to cooling applications* , http://www.piezofans.com/piezofans.php, pp. 1-2.
Daniel Schlitz, *SBIR Phase I: Compact Heat Sink using Microscale Ion Driven Air Flow*, Science Storm, sciencestorm.com/award/0340270.html, pp. 1-3.
Daniel Schlitz, *SBIR Phase II: Miniature Cooling System for Laptop Computers* , Science Storm, sciencestorm.com/award/0522126.html, pp. 1-3.
Press Release 08-041, Tiny Torrents, National Science Foundation, nsf.gov/news/news_summ.jsp?cntn_id . . . , Mar. 17, 2008, pp. 1-3.
Jason Lombarg, *Toshiba to release highly-efficient LED bulbs*, http://www.ecnmag.com/news-Toshiba-LED-bulbs-100509.aspx, Oct. 5, 2009, pp. 1-2.
U.S. Appl. No. 13/622,763, filed Sep. 19, 2012, Progl.
Litetronics International LED Parfection, 2010, pp. 1-2.
U.S. Appl. No. 13/089,807, filed Apr. 19, 2011, Pickard et al.
Gernert, Nelson, *Active heat sink technology delivers added performance*, Electronic Products, Developments in active heat sink technology, pp. 1-4, Dec. 2009.
Ansi C78.20/2003, Revision of C78.20/1995, American National Standard for electric lamps- A, G, PS and Similar Shapes with E25 Medium Screw Bases, (Oct., 2003), pp. 1-48.
Computer Cooling, Electronics Cooling, . . ., SynJet® Technology: Overview,www.noventix.com/technology. pp. 1-2, Dec. 2009.
Cooligy's Active Microchannel Cooling System, www.frostytech.com/articleview.cfm, pp. 1-2, Dec. 2009.
EE Times, Pin-fin heat sink integrates fan, www.cetimes.com/showarticle.ihtml, (Nov. 2009), pp. 1-2, Dec. 2009.
Indian origin scientists microchip-sized fan produces enough wind to cool a laptop, thaindian.com/ . . ./indian-origin-scientist . . ., Mar. 19, 2008, pp. 1-2.
Ionic Wind-Chillin' the PC, http://thefutureofthings.com/articles.p . . . Jan. 2, 2007, pp. 1-5.
LED *PARFECTION*™, The Perfectly Designed Green Lighting Solution, http//www.litetronics.com/advertising/led-perfection-perfectly-designed.html, Aug. 2010.
Philips, *Philips First to Submit to Depamnent of Energy L PRIZE$^{sm}$Competition with Development of LLED Replacment for Common Household Bulb*, Philips L PRIZE$^{sm}$Press Information, Sep. 24, 2009, pp. 1-3.
Coyne et al., *Giant Magnetoresistance: The Really Big Idea Behind a Very Tiny Tool*, Magnet Lab, www.magnet.fsu.edu/educution/ . . ./gmr/, pp. 1-4, Dec. 2009.
Dan Schlitz, *Dan Schlitz of Thorrn Micro Technologies, Inc., Describes Innovative Micro-fan Technology*, National Science Foundation, Press Release 08-041-Video, nsf.gov/news/news_videos.jsp?cntn_id . . ., pp. 1, Dec. 2009.
Nuventix, *Cooling LEDs is no longer a design obstacle*, Dual DLM Brochure, www.nuventix.com/led cooling. pp. 1-4, Dec. 2009.
By Nuventix, *SynJet® PAR20 LED Cooler with Heat Sink*, Design Guide, Version 1.0, Jul. 2009, pp. 1-33.
U.S. Appl. No. 12/476,356, filed Jun. 2, 2009, Van de Ven.
Piezo Fans, *PiezoFans, LLC brings the latest piezoelectric technology to cooling applications*, http://www.piezofans.com/piezofans.php, pp. 1-2, Dec. 2009.
Daniel Schlitz, *SBIR Phase I: Compact Heat Sink using Microscale Ion Driven Air Flow*, Science Storm, .K, sciencestorm.com/award/0340270.html, pp. 1-3, Dec. 2009.
Daniel Schlitz, *SBIR Phase II: Miniature Cooling System for Laptop Computers*, Science Storm, sciencestorm.com/award/0522126.html, pp. 1-3, Dec. 2009.
Daniel Schlitz, *Silent, microchip-sized 'fan' has no moving parts, yet produces enough wind to cool a laptop*, www.physorg.com/print125057974.html, Mar. 18, 2008 in Technology/Semiconductors, pp. 1-2.
THERMACORE, *Active Heat Sink Technology, AHST*, 2008, pp. 1.
Press Release 08-041, Tiny Torrents, National Science Foundation, nsf.gov/news/news_surnm.jsp?cntn_id . . ., Mar. 17, 2008, pp. 1-3.
Jason Lombarg, *Toshiba to release highly-efficient LED bulbs*, http:/ecnmag.com/news-Toshiba-LED-bulbs-100509.aspx, Oct. 5, 2009, pp.1-2.
Office Action from a corresponding European patent application bearing a mailing date of Mar. 26, 2015, 6 pages.

* cited by examiner

HEAT SINKS AND LAMP INCORPORATING SAME

CROSS-REFERENCE TO RELATED APPLICATIONS

This application is a continuation-in-part of U.S. patent application Ser. No. 12/582,206, filed Oct. 20, 2009 (now U.S. Patent Publication No. 2011/0090686), the entirety of which is incorporated herein by reference.

FIELD OF THE INVENTIVE SUBJECT MATTER

The inventive subject matter relates to the field of general illumination. In some aspects, the inventive subject matter relates to a lamp that comprises one or more solid state light emitters and that can be installed in a standard socket, e.g., a socket conventionally used for installing an incandescent lamp, a fluorescent lamp or any other type of lamp, such as an Edison socket or a GU-24 socket, for example. In some aspects, the inventive subject matter relates to such a lamp that is of a size and/or shape that is relatively close to a size and/or shape of a conventional lamp. In some aspects, the inventive subject matter relates to lamps that can provide high efficiency and good CRI Ra over long lamp lifetimes.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes than incandescent lights (e.g., fluorescent bulb typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

The color of visible light output by a light emitter, and/or the color of blended visible light output by a plurality of light emitters can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular color. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CM Chromaticity Diagram is similar to the 1931 Diagram, except that similar distances on the 1976 Diagram represent similar perceived differences in color.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIE Diagrams is referred to as the blackbody locus. The chromaticity coordinates (i.e., color points) that lie along the blackbody locus obey Planck's equation: $E(\lambda)=A\lambda^{-5}/(e^{(B/T)}-1)$, where E is the emission intensity, $\lambda$, is the emission wavelength, T is the color temperature of the blackbody and A and B are constants. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

The emission spectrum of any particular light emitting diode is typically concentrated around a single wavelength (as dictated by the light emitting diode's composition and structure), which is desirable for some applications, but not desirable for others, (e.g., for providing general illumination, such an emission spectrum provides a very low CRI Ra).

Because light that is perceived as white is necessarily a blend of light of two or more colors (or wavelengths), no single light emitting diode junction has been developed that can produce white light.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

LEDs are increasingly being used in lighting/illumination applications, such as traffic signals, color wall wash lighting, backlights, displays and general illumination, with one ultimate goal being a replacement for the ubiquitous incandescent light bulb. In order to provide a broad spectrum light source, such as a white light source, from a relatively narrow spectrum light source, such as an LED, the relatively narrow spectrum of the LED may be shifted and/or spread in wavelength.

For example, a white LED may be formed by coating a blue emitting LED with an encapsulant material, such as a resin or silicon, that includes therein a wavelength conversion material, such as a YAG:Ce phosphor, that emits yellow light in response to stimulation with blue light. Some, but not all, of the blue light that is emitted by the LED is absorbed by the phosphor, causing the phosphor to emit yellow light. The blue light emitted by the LED that is not absorbed by the phosphor combines with the yellow light emitted by the phosphor, to produce light that is perceived as white by an observer. Other combinations also may be used. For example, a red emitting phosphor can be mixed with the yellow phosphor to produce light having better color temperature and/or better color rendering properties. Alternatively, one or more red LEDs may be used to supplement the light emitted by the yellow phosphor-coated blue LED. In other alternatives, separate red, green and blue LEDs may be used. Moreover, infrared (IR) or ultraviolet (UV) LEDs may be used. Finally, any or all of these combinations may be used to produce colors other than white.

LED lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

LEDs also may be energy efficient, so as to satisfy ENERGY STAR® program requirements. ENERGY STAR program requirements for LEDs are defined in "*ENERGY STAR® Program Requirements for Solid State Lighting Luminaires, Eligibility Criteria—Version* 1.1", Final: Dec. 19, 2008, the disclosure of which is hereby incorporated herein by reference in its entirety as if set forth fully herein.

Heat is a major concern in obtaining a desirable operational lifetime. As is well known, an LED also generates considerable heat during the generation of light. The heat is generally measured by a "junction temperature", i.e., the temperature of the semiconductor junction of the LED. In order to provide an acceptable lifetime, for example, an L70 of at least 25,000 hours, it is desirable to ensure that the junction temperature should not be above 85° C. In order to ensure a junction temperature that is not above 85° C., various heat sinking schemes have been developed to dissipate at least some of the heat that is generated by the LED. See, for example, Application Note: CLD-APO6.006, entitled *Cree® XLamp® XR Family & 4550 LED Reliability*, published at cree.com/xlamp, September 2008.

In order to encourage development and deployment of highly energy efficient solid state lighting (SSL) products to replace several of the most common lighting products currently used in the United States, including 60-watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prize*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

One of the most common incandescent lamps in use today is the "A lamp" (often simply referred to as a "household light bulb"), which is widely employed in the United States.

FIG. 1 shows an example of an A lamp incandescent bulb 100, a Philips 75 watt (W) 120 volt (V) A 19 medium screw (E26) base frosted incandescent, having part number PL234153. Bulb 100 has a screw base 102 for screwing into a 120V lighting fixture and sealed glass bulb 104. Bulb 100 also has a nominal height, h, of 4.1 inches and a nominal width, w, of 2.4 inches. The upper portion of bulb 100 is generally hemispherical and the lower portion necks down to the screw base 102. In Europe and elsewhere, other standard incandescent bulb mounting arrangements are employed. In general, incandescent lamps are among the least energy efficient designs in use. A typical Philips bulb provides 1100 lumens using 75 watts of energy or 14.67 lumens per watt. As a result, some jurisdictions are mandating the phase out of such bulbs, and many consumers are beginning to phase out their use on their own.

Compact fluorescent lamps have been developed as retrofit replacement bulbs for use in standard incandescent sockets. Although they are typically more efficient, these fluorescent lamps present their own issues, such as environmental concerns related to the mercury employed therein, and in some cases questions of reliability and lifetime.

FIG. 2 shows an example of a compact fluorescent bulb 200 employing a GU-24 lamp base 202. GU describes the pin shape and 24 the spacing of the pins, which is 24 mm in a GU-24 lamp. Pins 204 and 206 in base 202 are inserted into a socket such as socket 210 of FIG. 2 and then the device can be twisted to lock bulb 200 in place. Power is connected to base 210 by electrical wiring 214.

A number of light emitting diode (LED) based A lamp replacement products have been introduced to the market. FIG. 3 illustrates an exploded view of a Topco Technologies Corp. LED lamp 300 having a lamp housing 310 comprising screw in plug 302, first cap 304, second cap 306, and lampshade 308. Lamp 300 also includes LED light source 320, heat sink 330, and control circuit 340. In another embodiment, a cooling fan can be employed. Further details of lamp 300 are found in U.S. Patent Application Publication No. 2009/0046473A1 which is incorporated by reference herein in its entirety. Such products typically utilize some sort of upper hemisphere shaped body for emitting light at the top of the lamp. A lower or bottom portion of the lamp, the portion which transitions to the neck and screw base, is utilized for thermal management and to enclose the power supply.

BRIEF SUMMARY OF THE INVENTIVE SUBJECT MATTER

There is therefore a need for high efficiency solid-state light sources that combine the efficiency and long life of solid state light emitters with an acceptable color temperature and good color rendering index, good contrast, a wide gamut and simple control circuitry.

Accordingly, for these and other reasons, efforts have been ongoing to develop ways by which solid state light emitters, which may or may not include luminescent material(s), can be used in place of incandescent lights, fluorescent lights and other light-generating devices (e.g., laser diodes, thin film electroluminescent devices, light emitting polymers (LEPs), halogen lamps, high intensity discharge lamps, electron-stimulated luminescence lamps, etc., each with or without one or more filters) in a wide variety of applications.

It would be especially desirable to provide a lamp that comprises one or more solid state light emitters (and in which some or all of the light produced by the lamp is generated by solid state light emitters), where the lamp can be easily substituted (i.e., retrofitted or used in place of initially) for a conventional lamp (e.g., an incandescent lamp, a fluorescent lamp or other conventional types of lamps), for example, a lamp (that comprises one or more solid state light emitters) that can be engaged with the same socket that the conventional lamp is engaged (a representative example being simply unscrewing an incandescent lamp from an Edison socket and threading in the Edison socket, in place of the incandescent lamp, a lamp that comprises one or more solid state light emitters). In some aspects of the present inventive subject matter, such lamps are provided.

A challenge with solid state light emitters is that many solid state light emitters do not operate as well as possible when they are subjected to elevated temperatures. For example, many light emitting diode light sources have average operating lifetimes of decades as opposed to just months or 1-2 years for many incandescent bulbs, but some light emitting diodes' lifetimes can be significantly shortened if they are operated at elevated temperatures. A common manufacturer recommendation is that the junction temperature of a light emitting diode should not exceed 70 degrees C. if a long lifetime is desired.

In addition, the intensity of light emitted from some solid state light emitters varies based on ambient temperature. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and blue InGaN+YAG:Ce light emitting diodes can reduce by about −0.15%/degree C.).

In many instances where lighting devices include solid state light emitters as light sources (e.g., general illumination devices that emit white light in which the light sources consist of light emitting diodes), a plurality of solid state light emitters are provided that emit light of different colors which, when mixed, are perceived as the desired color for the output light (e.g., white or near-white).

As noted above, the intensity of light emitted by many solid state light emitters, when supplied with a given current, can vary as a result of temperature change. The desire to maintain a relatively stable color of light output is therefore an important reason to try to reduce temperature variation of solid state light emitters.

In accordance with the present inventive subject matter, there are provided solid state light emitter lamps, i.e., lamps that comprise one or more solid state light emitters (and in some embodiments, lamps in which all or substantially all of the light generated by the lamp is generated by one or more solid state light emitters).

In some aspects of the present inventive subject matter, there are provided solid state light emitter lamps that provide good efficiency and that are within the size and shape constraints of the lamp for which the solid state light emitter lamp is a replacement. In some embodiments of this type, there are provided solid state light emitter lamps that provide lumen output of at least 600 lumens, and in some embodiments at least 750 lumens, at least 900 lumens or at least 1100 lumens (or in some cases at least even higher lumen outputs), and/or CRI Ra of at least 70, and in some embodiments at least 80, at least 85, at least 90 or at least 95).

In some aspects of the present inventive subject matter, which can include or not include any of the features described elsewhere herein, there are provided solid state light emitter lamps that provide sufficient lumen output (to be useful as a replacement for a conventional lamp), that provide good efficiency and that are within the size and shape constraints of the lamp for which the solid state light emitter lamp is a replacement. In some cases, "sufficient lumen output" means at least 75% of the lumen output of the lamp for which the solid state light emitter lamp is a replacement, and in some cases, at least 85%, 90%, 95%, 100%, 105%, 110%, 115%, 120% or 125% of the lumen output of the lamp for which the solid state light emitter lamp is a replacement.

In some aspects of the present inventive subject matter, which can include or not include any of the features described elsewhere herein, there are provided solid state light emitter lamps that provide good heat dissipation (e.g., in some embodiments, sufficient that the solid state light emitter lamp can continue to provide at least 70% of its initial wall plug efficiency for at least 25,000 hours of operation of the lamp, and in some cases for at least 35,000 hours or 50,000 hours of operation of the lamp).

In some aspects of the present inventive subject matter, which can include or not include any of the features described elsewhere herein, there are provided solid state light emitter lamps that achieve good CRI Ra.

In some aspects of the present inventive subject matter, which can include or not include any of the features described elsewhere herein, there are provided solid state light emitter lamps that emit light in a desired range of directions, e.g., substantially omnidirectionally or in some other desired pattern.

In accordance with an aspect of the present inventive subject matter, there is provided an A lamp that comprises at least a first solid state light emitter.

In accordance with another aspect of the present inventive subject matter, there is provided a lamp that comprises at least a first solid state light emitter and a power supply.

In accordance with another aspect of the present inventive subject matter, there is provided a lamp that comprises at least a first solid state light emitter and at least a first heat dissipation element.

In accordance with a first aspect of the present inventive subject matter, there is provided a lamp that comprises at least a first solid state light emitter, the lamp being an A lamp and providing a wall plug efficiency of at least 90 lumens per watt. In some embodiments, the lamp provides a wall plug efficiency of at least 95 lumens per watt, and in some embodiments, the lamp provides a wall plug efficiency of at least 100 lumens per watt or at least 104 lumens per watt.

In accordance with a second aspect of the present inventive subject matter, there is provided a lamp that comprises at least a first solid state light emitter and a power supply, the first solid state light emitter being mounted on a heat dissipation element, the power supply being electrically connected to the first solid state light emitter so that when line voltage is supplied to the power supply, the power supply feeds current to the first solid state light emitter, and the heat dissipation element being spaced from the power supply.

In accordance with a third aspect of the present inventive subject matter, there is provided a lamp that comprises at least a first solid state light emitter and at least a first heat dissipation element that comprises at least one dissipation region sidewall that defines at least one heat dissipation chamber, the first solid state light emitter being thermally coupled to the first heat dissipation element, the heat dissipation chamber having at least a first inlet opening and at least a first outlet opening, whereby an ambient medium can enter the first inlet opening, pass through the heat dissipation chamber and exit the first outlet opening.

In accordance with a fourth aspect of the present inventive subject matter, there is provided a lamp that comprises at least one light emissive housing, at least one solid state light emitter mounted within said light emissive housing and at least a first heat dissipation element thermally coupled to the at least one solid state emitter, the first heat dissipation element comprising at least one heat dissipation chamber. In such lamps, the heat dissipation chamber passes through at least a portion of the light emissive housing and comprises at least a first opening and at least a second opening, whereby an ambient medium flows through the heat dissipation chamber.

Some embodiments of the present inventive subject matter provide a solid state lamp (i.e., a lamp that comprises one or more solid state light emitters) that includes at least two solid state light emitters. In such embodiments, the at least two solid state light emitters can be disposed so that a primary axis of a light output of one of the at least two light emitters is in a direction in which the other (or others) of the at least two solid state light emitters directs no light. In some embodiments, a heat sink can be disposed between at least two light emitters, and the heat sink can define a space (between the at least two light emitters) that is exposed to an environment for heat rejection.

The expression "primary axis", as used herein in connection with light output from one or more light emitters, means an axis of the light emission from the light emitter, a direction of maximum intensity of light emission, or a mean direction of light emission (in other words, if the maximum intensity is in a first direction, but an intensity in a second direction ten degrees to one side of the first direction is larger than an intensity in a third direction ten degrees to an opposite side of the first direction, the mean intensity would be moved somewhat toward the second direction as a result of the intensities in the second direction and the third direction).

In some embodiments, which may include or not include any other feature described herein, a solid state lamp can include at least one lens disposed opposite a heat sink from at least one of at least two solid state light emitters. The heat sink and the lens can define at least one cavity in which the solid state light emitters) is/are disposed. A reflector can be provided in the at least one cavity. The solid state lamp may further include a diffuser associated with the at least one cavity to diffuse light from the solid state light emitter(s).

In some embodiments, which may include or not include any other feature described herein, a heat sink can be provided which comprises a substantially hollow structure having fins disposed therein, at least one of the solid state light emitters (e.g., all of them) emitting light in a direction away from the hollow portion of the heat sink.

In some embodiments, which may include or not include any other feature described herein, a lamp can be provided which is contained within the envelope of an A lamp (i.e., which meets the dimensional constraints for a lamp to be characterized as an A lamp).

In some embodiments, which may include or not include any other feature described herein, the lamp may have a correlated color temperature of greater than 2500 K and less than 4500 K, the lamp may have a CRI Ra of 90 or greater, and/or a lumen output of about 600 lumens or greater.

In some embodiments, which may include or not include any other feature described herein, the lamp may have a light output of from about 0° to about 150° axially symmetric.

Some embodiments of the present inventive subject matter provide a solid state lamp that includes a lower portion having an electrical contact and an upper portion that includes a heat sink comprising a plurality of outwardly facing mounting surfaces, each mounting face having a plurality of inwardly extending fins extending from a rear surface. In such embodiments, the plurality of outwardly facing mounting surfaces and inwardly extending fins define a central opening extending from the bottom to the top of the heat sink, light emitting diodes are supported by the exterior faces of the heat sink and at least one lens is provided associated with the light emitting diodes. In such embodiments, a stand connects the lower portion and the upper portion in a spaced relationship so as to allow air flow between the upper portion and the lower portion. In some embodiments, an electrical contact can comprise an Edison screw contact, a GU24 contact or a bayonet contact. The upper portion may have a form factor substantially corresponding to an A lamp. The lamp may provide at least about 600 lumens while passively dissipating at least about 6 W of heat. Driver circuitry may also be disposed within the lower portion to provide a self-ballasted lamp.

In some embodiments of the present inventive subject matter, there is provided a heat sink for a solid state lighting device, the heat sink including a main body section that defines a central opening extending longitudinally along the main body section. In such embodiments, the main body section can have at least one outwardly facing mounting surface configured to mount a solid state light emitter, and at least one inwardly extending fin can extend from the main body section into the central opening.

In some embodiments, a plurality of outwardly facing mounting surfaces can be provided, and a plurality of inwardly extending fins can also be provided. In some of such embodiments, an outer profile of the heat sink fits within the profile of an A lamp.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
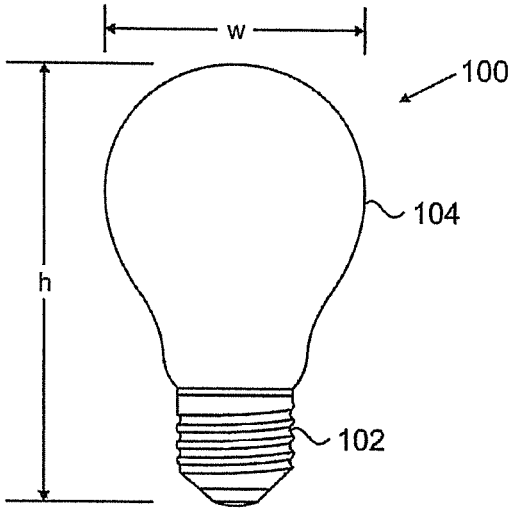
FIG. 1 (RELATED ART)
FIG. 1 shows an example of an incandescent light bulb.
Figure 2:
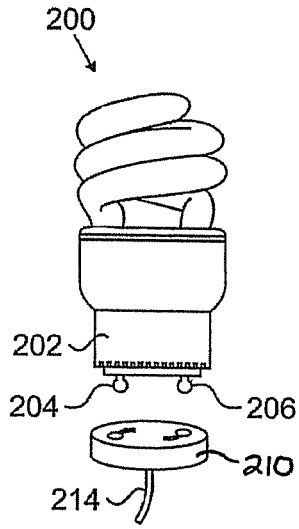
FIG. 2 (RELATED ART)
FIG. 2 shows an example of a compact fluorescent light bulb.

Embodiments of the present inventive subject matter now will be described more fully hereinafter with reference to the accompanying drawings, in which embodiments of the present inventive subject matter are shown. This present inventive subject matter may, however, be embodied in many different forms and should not be construed as being limited to the embodiments set forth herein. Rather, these embodiments are provided so that this disclosure will be thorough and complete, and will fully convey the scope of the present inventive subject matter to those skilled in the art. Like numbers refer to like elements throughout.

As used herein the term "and/or" includes any and all combinations of one or more of the associated listed items. All numerical quantities described herein are approximate and should not be deemed to be exact unless so stated.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

It will be understood that when a first element such as a layer, region or substrate is referred to as being "on" a second element, or extending "onto" a second element, or being "mounted on" a second element, the first element can be directly on or extend directly onto the second element, or can be separated from the second element structure by one or more intervening structures (each side, or opposite sides, of which is/are in contact with the first element, the second element or one of the intervening structures). In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. In addition, a statement that a first element is "on" a second element is synonymous with a statement that the second element is "on" the first element.

Relative terms, such as "lower", "bottom", "below", "upper", "top", "above," "horizontal" or "vertical" may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

The expression "illumination" (or "illuminated"), as used herein when referring to a light source, means that at least some current is being supplied to the light source to cause the light source to emit at least some electromagnetic radiation (e.g., visible light). The expression "illuminated" encompasses situations where the light source emits electromagnetic radiation continuously, or intermittently at a rate such that a human eye would perceive it as emitting electromagnetic radiation continuously or intermittently, or where a plurality of light sources of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The present inventive subject matter further relates to an illuminated enclosure (the volume of which can be illuminated uniformly or non-uniformly), comprising an enclosed space and at least one lamp according to the present inventive subject matter, wherein the lamp illuminates at least a portion of the enclosed space (uniformly or non-uniformly).

As noted above, some embodiments of the present inventive subject matter comprise at least a first power line, and some embodiments of the present inventive subject matter are directed to a structure comprising a surface and at least one lamp corresponding to any embodiment of a lamp according to the present inventive subject matter as described herein, wherein if current is supplied to the first power line, and/or if at least one solid state light emitter in the lamp is illuminated, the lamp would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lamp as described herein.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

The expression "thermally coupled", as used herein, means that heat transfer occurs between (or among) the two (or more) items that are thermally coupled. Such heat transfer encompasses any and all types of heat transfer, regardless of how the heat is transferred between or among the items. That is, the heat transfer between (or among) items can be by conduction, convection, radiation, or any combinations thereof, and can be directly from one of the items to the other, or indirectly through one or more intervening elements or spaces (which can be solid, liquid and/or gaseous) of any shape, size and composition. The expression "thermally coupled" encompasses structures that are "adjacent" (as defined herein) to one another. In some situations/embodiments, the majority of the heat transferred from the light source is transferred by conduction; in other situations/embodiments, the majority of the heat that is transferred from the light source is transferred by convection; and in some situations/embodiments, the majority of the heat that is transferred from the light source is transferred by a combination of conduction and convection.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein.

As noted above, in a first aspect, the present inventive subject matter provides a lamp that comprises at least a first solid state light emitter, the lamp being an A lamp and providing a wall plug efficiency of at least 90 lumens per watt. In some embodiments, the present inventive subject matter provides a lamp that has a wall plug efficiency of at least 100 lumens per watt. In some embodiments, the present inventive subject matter provides a lamp that has a wall plug efficiency of at least 104 lumens per watt.

An infinite number of varieties of lamps can be provided that fall within the definition of A lamps. For example, a number of different varieties of conventional A lamps exist and include those identified as A 15 lamps, A 17 lamps, A 19 lamps, A 21 lamps and A 23 lamps. The expression "A lamp" as used herein includes any lamp that satisfies the dimensional characteristics for A lamps as defined in ANSI C78.20-2003, including the conventional A lamps identified in the preceding sentence. The lamps according to the present inventive subject matter can satisfy (or not satisfy) any or all of the other characteristics for A lamps (defined in ANSI C78.20-2003).

The expression "wall plug efficiency", as used herein, is measured in lumens per watt, and means lumens exiting a lamp, divided by all energy supplied to create the light, as opposed to values for individual components and/or assemblies of components. Accordingly, wall plug efficiency, as used herein, accounts for all losses, including, among others, any quantum losses, i.e., losses generated in converting line voltage into current supplied to light emitters, the ratio of the number of photons emitted by luminescent material(s) divided by the number of photons absorbed by the luminescent material(s), any Stokes losses, i.e., losses due to the change in frequency involved in the absorption of light and the re-emission of visible light (e.g., by luminescent material(s)), and any optical losses involved in the light emitted by a component of the lamp actually exiting the lamp. In some embodiments, the lamps in accordance with the present inventive subject matter provide the wall plug efficiencies specified herein when they are supplied with AC power (i.e., where the AC power is converted to DC power before being supplied to some or all components, the lamp also experiences losses from such conversion), e.g., AC line voltage. The expression "line voltage" is used in accordance with its well known usage to refer to electricity supplied by an energy source, e.g., electricity supplied from a grid, including AC and DC.

Solid state light emitter lighting system lifetime is typically measured by an "L70 lifetime", i.e., a number of operational hours in which the light output of the LED lighting system (and therefore also the wall plug efficiency) does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

Various embodiments are described herein with reference to "expected L70 lifetime." Because the lifetimes of solid state lighting products are measured in the tens of thousands of hours, it is generally impractical to perform full term testing to measure the lifetime of the product. Therefore, projections of lifetime from test data on the system and/or light source are used to project the lifetime of the system. Such testing methods include, but are not limited to, the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein. Accordingly, the term "expected L70 lifetime" refers to the predicted L70 lifetime of a product as evidenced, for example, by the L70 lifetime projections of ENERGY STAR, ASSIST and/or a manufacturer's claims of lifetime.

Lamps according to some embodiments of the present inventive subject matter provide an expected L70 lifetime of at least 25,000 hours. Lamps according to some embodiments of the present inventive subject matter provide expected L70 lifetimes of at least 35,000 hours, and lamps according to some embodiments of the present inventive subject matter provide expected L70 lifetimes of at least 50,000 hours.

Persons of skill in the art are familiar with, and have ready access to, a wide variety of solid state light emitters, and any suitable solid state light emitter (or solid state light emitters) can be employed in the light engines according to the present inventive subject matter. A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Lamps according to the present inventive subject matter can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

The one or more solid state light emitters can be arranged in any suitable way.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley; , the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009/0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

In general, light of any number of colors can be mixed by the light engines according to the present inventive subject matter. Representative examples of blending of light colors are described in:

U.S. patent application Ser. No. 11/613,714, filed Dec. 20, 2006 (now U.S. Patent Publication No. 2007/0139920), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/736,799, filed Apr. 18, 2007 (now U.S. Patent Publication No. 2007/0267983), the entirety of which is hereby incorporated by reference as if set forth in its entirety;

U.S. patent application Ser. No. 11/737,321, filed Apr. 19, 2007 (now U.S. Patent Publication No. 2007/0278503), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 12/117,122, filed May 8, 2008 (now U.S. Patent Publication No. 2008/0304260), the entirety of which is hereby incorporated by reference as if set forth in its entirety;

U.S. patent application Ser. No. 12/117,131, filed May 8, 2008 (now U.S. Patent Publication No. 2008/0278940), the entirety of which is hereby incorporated by reference as if set forth in its entirety;

U.S. patent application Ser. No. 12/117,136, filed May 8, 2008 (now U.S. Patent Publication No. 2008/0278928), the entirety of which is hereby incorporated by reference as if set forth in its entirety;

U.S. Pat. No. 7,213,940 , issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley; , the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009/0296384), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/951,626, filed Dec. 6, 2007 (now U.S. Patent Publication No. 2008/0136313), the entirety of which is hereby incorporated by reference as if set forth in its entirety;

U.S. patent application Ser. No. 12/035,604, filed on Feb. 22, 2008 (now U.S. Patent Publication No. 2008/0259589), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley; attorney docket no. 931_081 PRO), the entirety of which is hereby incorporated by reference as if set forth in its entirety; and U.S. patent application Ser. No. 12/535,319, filed on Aug. 4, 2009 (now U.S. Patent Publication No. 2011/0031894), the entirety of which is hereby incorporated by reference as if set forth in its entirety.

As noted above, a second aspect of the present inventive subject matter relates to a lamp that comprises at least a first solid state light emitter and a power supply.

In the second aspect of the present inventive subject matter, the solid state light emitter can be any solid state light emitter as described above.

In addition, in the second aspect of the present inventive subject matter, any suitable power supply can be employed, skilled artisans being familiar with a wide variety of power supplies. Typical power supplies for light emitting diode light sources include linear current regulated supplies and/or pulse width modulated current and/or voltage regulated supplies.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Bergjohansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

In some embodiments, a power supply can be positioned within a base element, and at least 50 percent (in some cases, at least 60 percent, 70 percent, 80 percent, 90 percent or 95 percent) of a space defined by all points that are located between the heat dissipation element and the base element is filled with an ambient medium (e.g., a gaseous medium such as air). A base element can comprise an electrical connector (e.g., an Edison screw connector or a GU connector). In some embodiments, for instance, a power supply can be positioned inside an Edison screw connector, or a casing can be provided that includes a first region on which an Edison screw connector is mounted and a second region in which a power supply is positioned.

In some embodiments, line voltage is supplied to a power supply, the power supply feeds current to at least one solid state light emitter, at least some heat generated by the one or more solid state light emitter is dissipated by the heat dissipation element, at least some heat generated by the power supply is dissipated from a power supply heat dissipation element at a location that is spaced from the heat dissipation element, and not more than 10 percent of the heat generated by the first solid state light emitter is dissipated from the power supply heat dissipation element.

In embodiments according to the second aspect of the present inventive subject matter, the lamp can be of any suitable shape and size, e.g., in the shape and/or size of A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. Alternatively, the lamps can be of any suitable shape and size that does not conform to any of the types described above in this paragraph.

In embodiments according to the second aspect of the present inventive subject matter, the heat dissipation element can be made of any suitable thermally conductive material or combination of materials. Representative examples of suitable thermally conductive materials include extruded aluminum, forged aluminum, copper, thermally conductive plastics or the like. As used herein, a thermally conductive material refers to a material that has a thermal conductivity greater than air. In some embodiments, the heat dissipation element can be made of a material with a thermal conductivity of at least about 1 W/(m K), in some cases at least about 10 W/(m K), and in some cases at least about 100 W/(m K).

Some embodiments according to the second aspect of the present inventive subject matter can have wall plug efficiencies and/or expected L70 lifetime values as discussed above in connection with the first aspect of the present inventive subject matter.

As noted above, in a third aspect, the present inventive subject matter is directed to a lamp comprising at least a first solid state light emitter and at least a first heat dissipation element.

In the third aspect of the present inventive subject matter, the solid state light emitter can be any solid state light emitter as described above.

In embodiments according to the third aspect of the present inventive subject matter, the lamp can be of any suitable shape and size, as discussed above in connection with the second aspect of the present inventive subject matter.

Some embodiments according to the third aspect of the present inventive subject matter can have wall plug efficiencies and/or expected L70 lifetime values as discussed above in connection with the first aspect of the present inventive subject matter.

In some embodiments according to the third aspect of the present inventive subject matter, the heat dissipation element can comprise at least one dissipation region sidewall that defines at least one heat dissipation chamber, the heat dissipation chamber having at least a first inlet opening and at least a first outlet opening, whereby an ambient medium can enter the first inlet opening (or openings), pass through the heat dissipation chamber and exit the first outlet opening (or openings). The inlet opening(s) and the outlet opening(s) can each be of any suitable shape and size. In some of such embodiments, for example, a ratio of a cross-sectional area of the inlet opening (or a combined cross-sectional area of two or more inlet openings) divided by a cross-sectional area of the first outlet opening (or a combined cross-sectional area of two or more outlet openings) is at least 0.90, in some cases at least 0.95, in some cases at least 1.0, in some cases at least 1.1, and in some cases at least 1.2, and/or the cross-sectional area of the first inlet opening is at least 600 square millimeters (in some cases at least 700 square millimeters, in some cases at least 800 square millimeters, in some cases at least 900 square millimeters, and in some cases at least 1000 square millimeters), and/or the cross-sectional area of the first outlet opening is at least 600 square millimeters (in some cases at least 700 square millimeters, in some cases at least 800 square millimeters, in some cases at least 900 square millimeters, and in some cases at least 1000 square millimeters). In some embodiments, for instance, the inlet opening(s) can comprise a plurality of openings of relatively small cross-sectional area, and the outlet opening(s) can comprise a single opening of comparatively large cross-sectional area, or vice-versa. In some embodiments, the sizes of the openings (or the sum of the cross-sectional areas of the inlet openings and/or the sum of the cross-sectional areas of the outlet openings) can be adjusted based on (1) the temperature difference between the surfaces of the chamber and the temperature of the ambient medium, and/or (2) the rate that heat is being generated by the solid state light emitters, and/or (3) the surface area for heat exchange between the heat dissipation chamber (or fins extending therefrom) and the ambient medium, as a greater temperature difference will tend to increase the rate of flow of the ambient medium, the sizes of the openings (and/or the sums of the inlet opening and the sums of the outlet opening), and the ratio between the same, will affect the rate of flow of the ambient medium, and the amount of heat being generated by the solid state light emitters will determine the rate that heat has to be removed, and the surface area for heat exchange will affect the rate of heat dissipation (and thus removal from the solid state light emitter(s).

In some embodiments according to the third aspect of the present inventive subject matter, which may include or not include any other feature described herein, the first heat dissipation element further comprises at least one fin that extends into the heat dissipation chamber. In such embodiments, the one or more fin can be integral with the heat dissipation element or can be attached (e.g., by adhesive, bolts, screws, rivets, etc.) to it (or one or more fins can be integral and one or more can be attached), and the fin can be made of any suitable thermally conductive material or combination of materials as discussed above. Multiple heat dissipation elements and/or fins may be provided as part of a unitary structure, as individual structures or as any suitable combination of unitary and combined structures. In some embodiments according to the third aspect of the present inventive subject matter, which may include or not include any other feature described herein, when line voltage is supplied to the lamp, the at least a first solid state light emitter generates heat that is dissipated in ambient medium located inside the heat dissipation chamber, causing the ambient medium located inside the heat dissipation chamber to absorb heat, causing the ambient medium located inside the heat dissipation chamber to rise and exit through the first outlet opening, thereby generating negative pressure within the heat dissipation chamber and causing ambient medium that is outside the heat dissipation chamber to enter the first inlet opening into the heat dissipation chamber.

As noted above, in accordance with a fourth aspect of the present inventive subject matter, there is provided a lamp that comprises at least one light emissive housing, at least one solid state light emitter and at least a first heat dissipation element thermally coupled to the at least one solid state emitter. In such lamps, the solid state light emitter(s) can be any solid state light emitter as described above, the lamp can be of any suitable shape and size as discussed above, the lamp can have wall plug efficiencies and/or expected L70 lifetime values as discussed above, the light emissive housing can be made of any suitable material or combination of materials (in some cases, substantially transparent or translucent materials), and the heat dissipation element(s) can be made of any suitable thermally conductive material or combination of materials as discussed above.

In some embodiments according to the present inventive subject matter, the lamp emits at least 600 lumens (in some embodiments at least 750 lumens, in some embodiments at least 800 lumens, in some embodiments at least 850 lumens, in some embodiments at least 900 lumens, at least 950 lumens, at least 1000 lumens, at least 1050 lumens or at least 1100 lumens) when the lamp is energized (e.g., by supplying line voltage to the lamp).

In some embodiments according to the present inventive subject matter, the lamp emits light having CRI Ra of at least 75 (in some embodiments at least 80, in some embodiments at least 85, in some embodiments at least 90, and in some embodiments at least 95) when the lamp is energized.

In some embodiments according to the present inventive subject matter, the lamp comprises at least one solid state light emitter that, if energized, emits BSY light, and at least one solid state light emitter that, if energized, emits light that is not BSY light.

The expression "BSY light", as used herein, means light having x, y color coordinates which define a point which is within (1) an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53

In some embodiments according to the present inventive subject matter, when the lamp is energized, a mixture of light emitted by the solid state light emitters in the lamp is within about 10 MacAdam ellipses of the blackbody locus on a 1931 CIE Chromaticity Diagram. In some of such embodiments:

(1) the at least one solid state light emitter that, if energized, emits light that is not BSY light emits light that has a dominant wavelength in the range of from about 600 nm to about 630 nm, and/or (2) the at least one solid state light emitter that, if energized, emits BSY light comprises a first group of at least one light emitting diode, the at least one solid state light emitter that, if energized, emits light that is not BSY light comprises a second group of at least one light emitting diode, the first and second groups of light emitting diodes are mounted on at least one circuit board, and an average distance between a center of each light emitting diode in the first group and a closest point on an edge of the circuit board on which that light emitting diode is mounted is smaller than an average distance between a center of each light emitting diode in the second group and a closest point on an edge of the circuit board on which that light emitting diode is mounted.

The lamps according to the present inventive subject matter can direct light in any generally and desired range of directions. For instance, in some embodiments, the lamp can direct light substantially omnidirectionally (i.e., substantially 100% of all directions extending from a center of the lamp), i.e., within a volume defined by a two-dimensional shape in an x, y plane that encompasses rays extending from 0 degrees to 180 degrees relative to the y axis (i.e., 0 degrees extending from the origin along the positive y axis, 180 degrees extending from the origin along the negative y axis), the two-dimensional shape being rotated 360 degrees about the y axis (in some cases, the y axis can be a vertical axis of the lamp). In some embodiments, the lamp emits light substantially in all directions within a volume defined by a two-dimensional shape in an x, y plane that encompasses rays extending from 0 degrees to 150 degrees relative to the y axis (extending along a vertical axis of the lamp), the two-dimensional shape being rotated 360 degrees about the y axis. In some embodiments, the lamp emits light substantially in all directions within a volume defined by a two-dimensional shape in an x, y plane that encompasses rays extending from 0 degrees to 120 degrees relative to the y axis (extending along a vertical axis of the lamp), the two-dimensional shape being rotated 360 degrees about the y axis. In some embodiments, the lamp emits light substantially in all directions within a volume defined by a two-dimensional shape in an x, y plane that encompasses rays extending from 0 degrees to 90 degrees relative to the y axis (extending along a vertical axis of the lamp), the two-dimensional shape being rotated 360 degrees about the y axis (i.e., a hemispherical region). In some embodiments, the two-dimensional shape can instead encompass rays extending from an angle in the range of from 0 to 30 degrees (or from 30 degrees to 60 degrees, or from 60 degrees to 90 degrees) to an angle in the range of from 90 to 120 degrees (or from 120 degrees to 150 degrees, or from 150 degrees to 180 degrees). In some embodiments, the range of directions in which the lamp emits light can be non-symmetrical about any axis, i.e., different embodiments can have any suitable range of directions of light emission, which can be continuous or discontinuous (e.g., regions of ranges of emissions can be surrounded by regions of ranges in which light is not emitted). In some embodiments, the lamp can emits light in at least 50% of all directions extending from a center of the lamp (e.g., hemispherical being 50%), and in some embodiments at least 60%, 70%, 80%, 90% or more.

In some embodiments according to the present inventive subject matter, solid state light emitters are electrically arranged in series with enough solid state light emitters being present to match (or to come close to matching) the voltage supplied from to the solid state light emitters (e.g., in some embodiments, the DC voltage obtained by rectifying line AC current and supplying it to the solid state light emitters via a power supply). For instance, in some embodiments, sixty-eight solid state light emitters (or other numbers, as needed to match the line voltage) can be arranged in series, so that the voltage drop across the entire series is about 162 volts. Providing such matching can help provide power supply efficiencies and thereby boost the overall efficiency of the lamp. In such lamps, total lumen output can be regulated by adjusting the current supplied to the series of solid state light emitters.

The lamps according to the present inventive subject matter can emit light of generally any desired CCT or within any desired range of CCT. In some embodiments, there are provided lamps that emit light having a correlated color temperature (CCT) of between about 2500K and about 4000K. In some embodiments, the CCT may be as defined in the Energy Star Requirements for Solid State Luminaires, Version 1.1, promulgated by the United States Department of Energy.

In some embodiments, there are provided lamps that emit light that has a correlated color temperature (CCT) of about 2700K and that has x, y color coordinates that define a point which is within an area on a 1931 CIE Chromaticity Diagram defined by points having x, y coordinates of (0.4578, 0.4101), (0.4813, 0.4319), (0.4562, 0.4260), (0.4373, 0.3893), and (0.4593, 0.3944).

In some embodiments, there are provided lamps that emit light that has a correlated color temperature (CCT) of about 3000K and that has x, y color coordinates that define a point which is within an area on a 1931 CIE Chromaticity Diagram defined by points having x, y coordinates of (0.4338, 0.4030), (0.4562, 0.4260), (0.4299, 0.4165), (0.4147, 0.3814), and (0.4373, 0.3893).

In some embodiments, there are provided lamps that emit light that has a correlated color temperature (CCT) of about 3500K and that has x, y color coordinates that define a point which is within an area on a 1931 CIE Chromaticity Diagram defined by points having x, y coordinates of (0.4073, 0.3930), (0.4299, 0.4165), (0.3996, 0.4015), (0.3889, 0.3690), (0.4147, 0.3814).

Some embodiments according to the present inventive subject matter further comprise one or more printed circuit boards, on which the one or more solid state light emitters can be mounted. Persons of skill in the art are familiar with a wide variety of circuit boards, and any such circuit boards can be employed in the lighting devices according to the present inventive subject matter. One representative example of a circuit board with a relatively high heat conductivity is a metal core printed circuit board.

Some embodiments in accordance with the present inventive subject matter can include one or more lenses or diffusers. Persons of skill in the art are familiar with a wide variety of lenses and diffusers, can readily envision a variety of materials out of which a lens or a diffuser can be made (e.g., polycarbonate or acrylic materials), and are familiar with and/or can envision a wide variety of shapes that lenses and diffusers can be. Any of such materials and/or shapes can be employed in a lens and/or a diffuser in an embodiment that includes a lens and/or a diffuser. As will be understood by persons skilled in the art, a lens or a diffuser in a lamp according to the present inventive subject matter can be selected to have any desired effect on incident light (or no effect), such as focusing, diffusing, etc.

In embodiments in accordance with the present inventive subject matter that include a diffuser (or plural diffusers), the diffuser (or diffusers) can be positioned in any suitable location and orientation.

In embodiments in accordance with the present inventive subject matter that include a lens (or plural lenses), the lens (or lenses) can be positioned in any suitable location and orientation.

In addition, one or more scattering elements (e.g., layers) can optionally be included in the lamps according to this aspect of the present inventive subject matter. The scattering element can be included in a lumiphor, and/or a separate scattering element can be provided. A wide variety of separate scattering elements and combined luminescent and scattering elements are well known to those of skill in the art, and any such elements can be employed in the lamps of the present inventive subject matter.

Any desired circuitry (including any desired electronic components) can be employed in order to supply energy to the one or more light sources according to the present inventive subject matter. Representative examples of circuitry which may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

For example, solid state lighting systems have been developed that include a power supply that receives the AC line voltage and converts that voltage to a voltage (e.g., to DC and to a different voltage value) and/or current suitable for driving solid state light emitters. Power supplies as discussed above can be employed.

Various types of electrical connectors are well known to those skilled in the art, and any of such electrical connectors can be used in the lamps according to the present inventive subject matter. Representative examples of suitable types of electrical connectors include Edison plugs (which are receivable in Edison sockets) and GU24 pins (which are receivable in GU24 sockets).

In some embodiments according to the present inventive subject matter, the lamp is a self-ballasted device. For example, in some embodiments, the lamp can be directly connected to AC current (e.g., by being plugged into a wall receptacle, by being screwed into an Edison socket, by being hard-wired into a branch circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

Some embodiments in accordance with the present inventive subject matter can comprise a power line that can be connected to a source of power (such as a branch circuit, a battery, a photovoltaic collector, etc.) and that can supply power to an electrical connector (or directly to the lamp). Persons of skill in the art are familiar with, and have ready access to, a variety of structures that can be used as a power line. A power line can be any structure that can carry electrical energy and supply it to an electrical connector on a fixture element and/or to a lamp according to the present inventive subject matter.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

Energy can be supplied to the lamps according to the present inventive subject matter from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

The present inventive subject matter is also directed to lamps that may further comprise a fixture element (e.g., in which the lamp is electrically connected to a fixture element, such as by an Edison plug being threaded in an Edison socket on the fixture element). The fixture element can comprise a housing, a mounting structure, and/or an enclosing structure. Persons of skill in the art are familiar with, and can envision, a wide variety of materials out of which a fixture element, a housing, a mounting structure and/or an enclosing structure can be constructed, and a wide variety of shapes for such a fixture element, a housing, a mounting structure and/or an enclosing structure. A fixture element, a housing, a mounting structure and/or an enclosing structure made of any of such materials and having any of such shapes can be employed in accordance with the present inventive subject matter.

For example, fixture elements, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety; U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; , the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,819, filed on May 21, 2009 (now U.S. Patent Publication No. 2010/00102199), the entirety of which is hereby incorporated by reference as if set forth in its entirety; and U.S. patent application Ser. No. 12/469,828, filed on May 21, 2009 (now U.S. Patent Publication No. 2010/0103678), the entirety of which is hereby incorporated by reference as if set forth in its entirety.

The lamps according to the present inventive subject matter can further comprise elements that help to ensure that the perceived color (including color temperature) of the light exiting the lamp is accurate (e.g., within a specific tolerance). A wide variety of such elements and combinations of elements are known, and any of them can be employed in the lamps according to the present inventive subject matter. For instance, representative examples of such elements and combinations of elements are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

Some embodiments in accordance with the present inventive subject matter comprise a controller configured to control a ratio of emitted light of at least a first color point (or range of color points) and emitted light of a second color (or range of colors) such that a combination of the emitted light is within a desired area on a CIE Chromaticity Diagram.

Persons of skill in the art are familiar with, have access to, and can readily envision a variety of suitable controllers that can be used to control the above ratio, and any of such controllers can be employed in accordance with the present inventive subject matter.

A controller may be a digital controller, an analog controller or a combination of digital and analog. For example, the controller may be an application specific integrated circuit (ASIC), a microprocessor, a microcontroller, a collection of discrete components or combinations thereof. In some embodiments, the controller may be programmed to control the lighting devices. In some embodiments, control of the lighting devices may be provided by the circuit design of the controller and is, therefore, fixed at the time of manufacture. In still further embodiments, aspects of the controller circuit, such as reference voltages, resistance values or the like, may be set at the time of manufacture so as to allow adjustment of the control of the lighting devices without the need for programming or control code.

Representative examples of suitable controllers are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety; and U.S. patent application Ser. No. 12/257,804, filed on Oct. 24, 2008 (now U.S. Patent Publication No. 2009/0160363), the entirety of which is hereby incorporated by reference as if set forth in its entirety.

In some embodiments of the present inventive subject matter, a set of parallel solid state light emitter strings (i.e., two or more strings of solid state light emitters arranged in parallel with each other) can be arranged in series with a power line, such that current is supplied through the power line to each of the respective strings of solid state light emitters. The expression "string", as used herein, means that at least two solid state light emitters are electrically connected in series. In some such embodiments, the relative quantities of solid state light emitters in the respective strings differ from one string to the next, e.g., a first string contains a first percentage of solid state light emitters that emit BSY light and a second string contains a second percentage (different from the first percentage) of solid state light emitters that emit BSY light. As a representative example, first and second strings each contain solely (i.e., 100%) solid state light emitters that emit BSY light, and a third string contains 50% solid state light emitters that emit BSY light and 50% solid state light emitters that emit non-BSY light, e.g., red light (each of the three strings being electrically connected in parallel to each other and in series with a common power line). By doing so, it is possible to easily adjust the relative intensities of the light of the respective wavelengths, and thereby effectively navigate within the CIE Diagram and/or compensate for other changes. For example, the intensity of non-BSY light can be increased, when necessary, in order to compensate for any reduction of the intensity of the light generated by the solid state light emitters that emit non-BSY light. Thus, for instance, in the representative example described above, by increasing or decreasing the current supplied to the third power line, and/or by increasing or decreasing the current supplied to the first power line and/or the second power line (and/or by intermittently interrupting the supply of power to the first power line or the second power line), the x, y coordinates of the mixture of light emitted from the lamp can be appropriately adjusted.

As noted above, the solid state light emitters (and any luminescent material) can be arranged in any desired pattern.

Some embodiments according to the present inventive subject matter include solid state light emitters that emit BSY light and solid state light emitters that emit light that is not BSY light (e.g., that is red or reddish or reddish orange or orangish, or orange light), where each of the solid state light emitters that emit light that is not BSY light is surrounded by five or six solid state light emitters that emit BSY light.

In some embodiments, solid state light emitters (e.g., where a first group includes solid state light emitters that emit non-BSY light, e.g., red, reddish, reddish-orange, orangish or orange light, and a second group includes solid state light emitters that emit BSY light) may be arranged pursuant to a guideline described below in paragraphs (1)-(5), or any combination of two or more thereof, to promote mixing of light from light sources emitting different colors of light:

(1) an array that has groups of first and second solid state light emitters with the first group of solid state light emitters arranged so that no two of the first group solid state light emitters are directly next to one another in the array;

(2) an array that comprises a first group of solid state light emitters and one or more additional groups of solid state light emitters, the first group of solid state light emitters being arranged so that at least three solid state light emitters from the one or more additional groups is adjacent each of the solid state light emitters in the first group;

(3) an array is mounted on a submount, and the array comprises a first group of solid state light emitters and one or more additional groups of solid state light emitters, and (c) the array is arranged so that less than fifty percent (50%), or as few as possible, of the solid state light emitters in the first group of solid state light emitters are on the perimeter of the array;

(4) an array comprises a first group of solid state light emitters and one or more additional groups of solid state light emitters, and the first group of solid state light emitters is arranged so that no two solid state light emitters from the first group are directly next to one another in the array, and so that at least three solid state light emitters from the one or more additional groups is adjacent each of the solid state light emitters in the first group; and/or (5) an array is arranged so that no two solid state light emitters from the first group are directly next to one another in the array, fewer than fifty percent (50%) of the solid state light emitters in the first group of solid state light emitters are on the perimeter of the array, and at least three solid state light emitters from the one or more additional groups is adjacent each of the solid state light emitters in the first group.

It is understood that arrays according to the present inventive subject matter can also be arranged other ways, and can have additional features, that promote color mixing. In some embodiments, solid state light emitters can be arranged so that they are tightly packed, which can further promote natural color mixing. The lamps can also comprise different diffusers and reflectors to promote color mixing in the near and far field.

Figure 3:
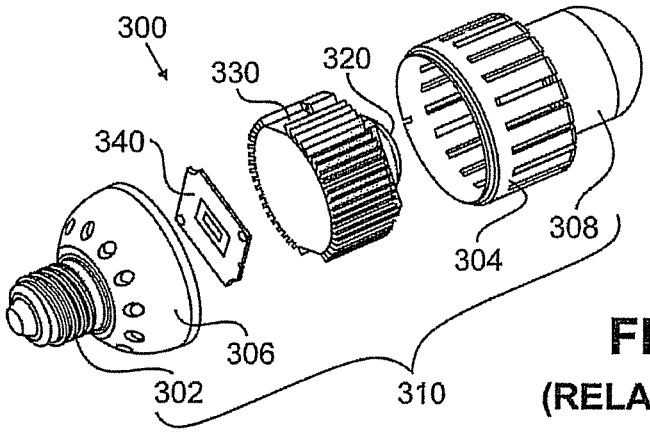
FIG. 3 (RELATED ART)
FIG. 3 shows an example of an LED lamp.

A problem that can occur with passive LED approaches like the one shown in FIG. 3 is that in order to generate a comparable amount of light as the Philips 75 W incandescent lamp, for example, the most efficient LEDs still require approximately 6-10 W of thermal dissipation capacity. The amount of surface area available within the lower portion of an A-lamp like retrofit structure cannot in some cases passively dissipate this amount of heat without an unacceptable temperature rise, which in turn would raise the LED junction temperature, thereby potentially reducing LED lifetime and performance. Another alternative is to limit the lumen output so that less heat needs to be dissipated, but such approaches may result in insufficiently bright lamps that are unacceptable to many consumers. A further alternative is to employ an active cooling solution, for example, such as a fan to move air across the heat sink in order to lower the temperature of the heat sink and the LED junction temperature to an acceptable level. However, such active cooling approaches present their own issues, such as cost, weight, noise, ease of manufacture and possible negative impact on the form factor of the lamp, for example.

One aspect of the present inventive subject matter relates to providing lamps that can be used in place of incandescent A-lamps (and other lamps of other sizes, shapes and type of light production, such as fluorescent, laser diodes, thin film electroluminescent devices, light emitting polymers (LEPs), halogen lamps, high intensity discharge lamps, electron-stimulated luminescence lamps, etc., each with or without one or more filters) with a solid state alternative in order to reduce overall energy consumption and minimize environmental impact while not employing an active cooling approach, such as a fan, and while maintaining a reasonable conformance to the A-lamp form factor. The size and volume constraints of the A-lamp make a solid state design particularly challenging with an important constraint being the amount of volume available for passive thermal management. The present inventive subject matter provides unique approaches to such management.

In some embodiments, the present inventive subject matter addresses such problems by turning the fins of the heat sink inwards rather than outwards. Additionally, in some embodiments, LEDs used as a solid state source can be mounted toward the exterior of the lamp as discussed in further detail below. By using the volume of the A-lamp shape more fully and effectively, additional heat sink surface area is provided, more effective ambient cooling occurs, and dissipation of higher wattages or heat with acceptable LED junction temperatures can be achieved than by arrangements in which the heat sink fins are fit into the narrower neck section of the A-lamp. While the embodiments illustrated in the present drawing figures are shown as A-lamp replacements, the teachings of the illustrated embodiments are applicable to other lamp replacements, as well as new solid state lamp designs.

In particular, while the illustrated embodiments of the present inventive subject matter are shown as LED based solid state lamps having a form factor making it suitable as a retrofit replacement for an incandescent A lamp, the teachings of the illustrated embodiments are applicable to other types of lamps, mounting arrangements and shapes. As an example, while an Edison screw type connector is depicted, the teachings are applicable to GU-24, bayonet, or other presently available or future-developed connectors. Similarly, the teachings are applicable to replacements for bulbs having other form factors, as well as new lamp designs. While four planar mounting faces are shown, other numbers and shapes or a mix of shapes may be employed.

As used herein, the term "A lamp" refers to a lamp that fits within one of the ANSI standard dimensions designated "A", such as A19, A21, etc. as described, for example, in ANSI C78.20-2003 or other such standards. Embodiments of the present inventive subject matter can alternatively be other lamp sizes, including conventional lamp sizes, such as G and PS lamps or non-conventional lamp sizes.

The expression "thermal equilibrium" refers to supplying current to one or more light sources in a lamp to allow the light source(s) and other surrounding structures to heat up to (or near to) a temperature to which they will typically be heated when the lamp is energized. The particular duration that current should be supplied will depend on the particular configuration of the lamp. For example, the greater the thermal mass, the longer it will take for the light source(s) to approach their thermal equilibrium operating temperature. While a specific time for operating the lamp prior to reaching thermal equilibrium may be lamp specific, in some embodiments, durations of from about 1 to about 60 minutes or more and, in specific embodiments, about 30 minutes, may be used. In some instances, thermal equilibrium is reached when the temperature of the light source (or each of the light sources) does not vary substantially (e.g., more than 2 degrees C.) without a change in ambient or operating conditions.

In many situations, the lifetime of light sources, e.g., solid state light emitters, can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of a thermal management system of a lamp is/are selected so as to dissipate heat at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

In some instances, color output can be analyzed while the light emitters (or the entire lamp) are at ambient temperature, e.g., substantially immediately after the light emitter (or light emitters, or the entire lamp) is illuminated. The expression "at ambient temperature", as used herein, means that the light emitters) is within 2 degrees C. of the ambient temperature. As will be appreciated by those of skill in the art, the "ambient temperature" measurement may be taken by measuring the light output of the device in the first few milliseconds or microseconds after the device is energized.

In light of the above discussion, in some embodiments, light output characteristics, such as lumen output, chromaticity (correlated color temperature (CCT)) and/or color rendering index (CRI) are measured with the solid state light emitters, such as LEDs, at thermal equilibrium. In other embodiments, light output characteristics, such as lumens, CCT and/or CRI are measured with the solid state light emitters at ambient temperature. Accordingly, references to lumen output, CCT or CRI describe some embodiments where the light characteristics are measured with the solid state light emitters at thermal equilibrium and other embodiments where the light characteristics are measured with the solid state light emitters at ambient temperature.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 4:
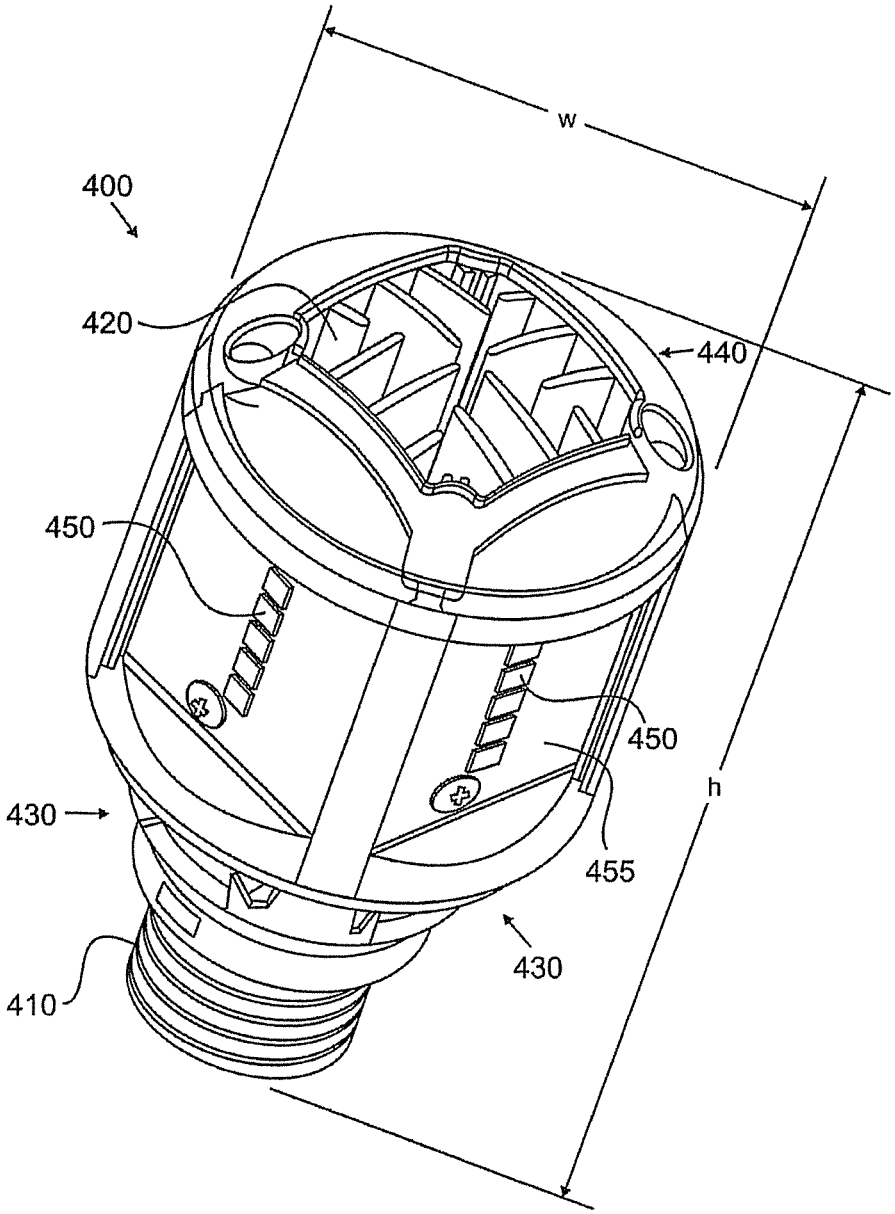
FIG. 4 is a top perspective view of a solid state lamp in accordance with the present inventive subject matter.
Figure 5:
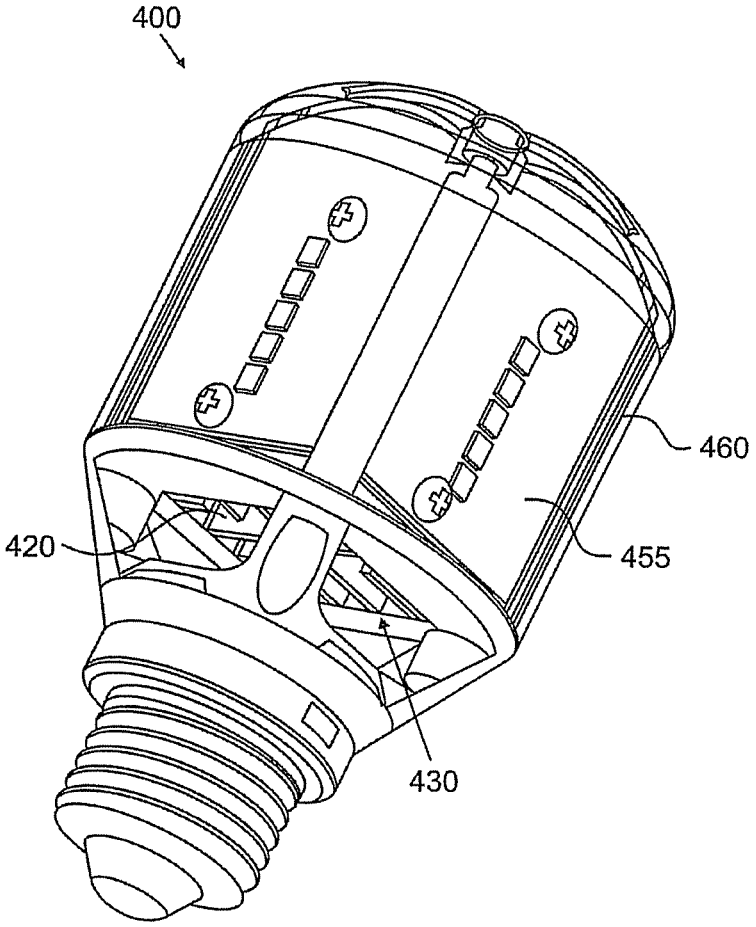
FIG. 5 is a bottom perspective of the compact solid state lamp of FIG. 4.

FIG. 4 shows a top perspective view of a solid state lamp 400 in accordance with some embodiments of the present inventive subject matter. FIG. 5 shows a bottom perspective of the lamp 400. Lamp 400 has a standard screw type connector 410, a height, h, of approximately 108.93 millimeters (mm) or 4.3 in and a width, w, of approximately 58 mm or 2.3 in. As such, it has a form factor that falls within an ANSI standard A19 medium screw base lamp illustrated in Figure C.78-20-211 which has a maximum height of 112.7 mm and a maximum width of 69.5 mm. The illustrative dimensions of lamp 400 fall well within these ranges. It will be recognized that these illustrative dimensions may be altered to meet the demands of a wide variety of lighting applications. For example, larger dimensions could be provided for higher output lamps, such as an A21 lamp, or smaller dimensions could be provided for lower output lamps, such as an A15 lamp.

From FIGS. 4 and 5, it will be seen that heat sink 420 has a plurality of inward facing fins that extend into a cavity defined by a body section of the heat sink. The surface area provided by these inward facing fins enables the dissipation of higher wattages with acceptable temperatures as compared with existing solid state designs which force the heat sink fins to the narrow bottom section of the A-lamp. A bottom opening 430 and a top opening 440 allow efficient convection air cooling of the lamp 400 as discussed further below. Rather than being bunched centrally, LEDs 450 are mounted on outward facing external mounting surfaces of the heat sink 420. The physical dispersal of LEDs 450 serves to disperse the heat generated by the LEDs 450, and may reduce thermal coupling between LEDs and/or between subsets of the LEDs.

As seen in FIGS. 4 and 5, LEDs 450 are disposed so that a primary axis of a light output of one set of the LEDs 450 is in a direction in which the other sets of LEDs 450 do not direct light. In other words, the LEDs 450 are configured to provide 360° of light despite each set of LEDs only producing about 180° of light.

The heat sink 420 may be made of any suitable thermally conductive material. Examples of suitable thermally conductive materials include extruded aluminum, forged aluminum, copper, thermally conductive plastics or the like. As used herein, a thermally conductive material refers to a material that has a thermal conductivity greater than air. In some embodiments, the heat sink 420 is made of a material with a thermal conductivity of at least about 1 W/(m K). In other embodiments, the heat sink 420 is made of a material with a thermal conductivity of at least about 10 W/(m K). In still further embodiments, the heat sink 420 is made of a material with a thermal conductivity of at least about 100 W/(m K).

Additionally, side lenses 460 are provided to define a mixing cavity 455 in which the LEDs 450 are mounted. The mixing cavity 455 may act as a mixing chamber to combine light from the LEDs 450 disposed within the mixing cavity 455. The side lenses 460 may be transparent or diffusive. In some embodiments, a diffuser film 462 can be provided between the LEDs 450 and the side lens 460. Diffuser films are available from Fusion Optix of Woburn, MA, BrightView Technologies of Morrisville, N.C., Luminit of Torrance, Calif. or other diffuser film manufacturers. Alternatively or additionally, the side lenses 460 may be diffusive, for example, by incorporating scattering material within the side lenses, patterning a diffusion structure on the side lenses or providing a diffusive film disposed within the mixing cavity 455 or on the lens 460. Diffuser structures having diffusive material within the lens may also be utilized. Diffusive materials that may be molded to form a desired lens shape and incorporate a diffuser are available from Bayer Material Science or SABIC. The mixing chamber may be lined with a reflector, such as the reflector plate 452 or may be made reflective itself. The reflective interior of the cavity 455 may be diffuse to enhance mixing. Diffuse reflector materials are available from Furukawa Industries and Dupont Nonwovens. By providing a mixing chamber that utilizes refractive and reflective mixing, the spatial separation between the LEDs 450 and the side lens 460 required to mix the light output of the LEDs 450 may be sufficiently large to allow for near field mixing of the light. Optionally, the LEDs 450 may be obscured from view by a diffuser structure as described above such that the LEDs 450 do not appear as point sources when the lamp 400 is illuminated. In particular embodiments, the mixing chamber provides near field mixing of the light output of the LEDs 450.

Figure 6:
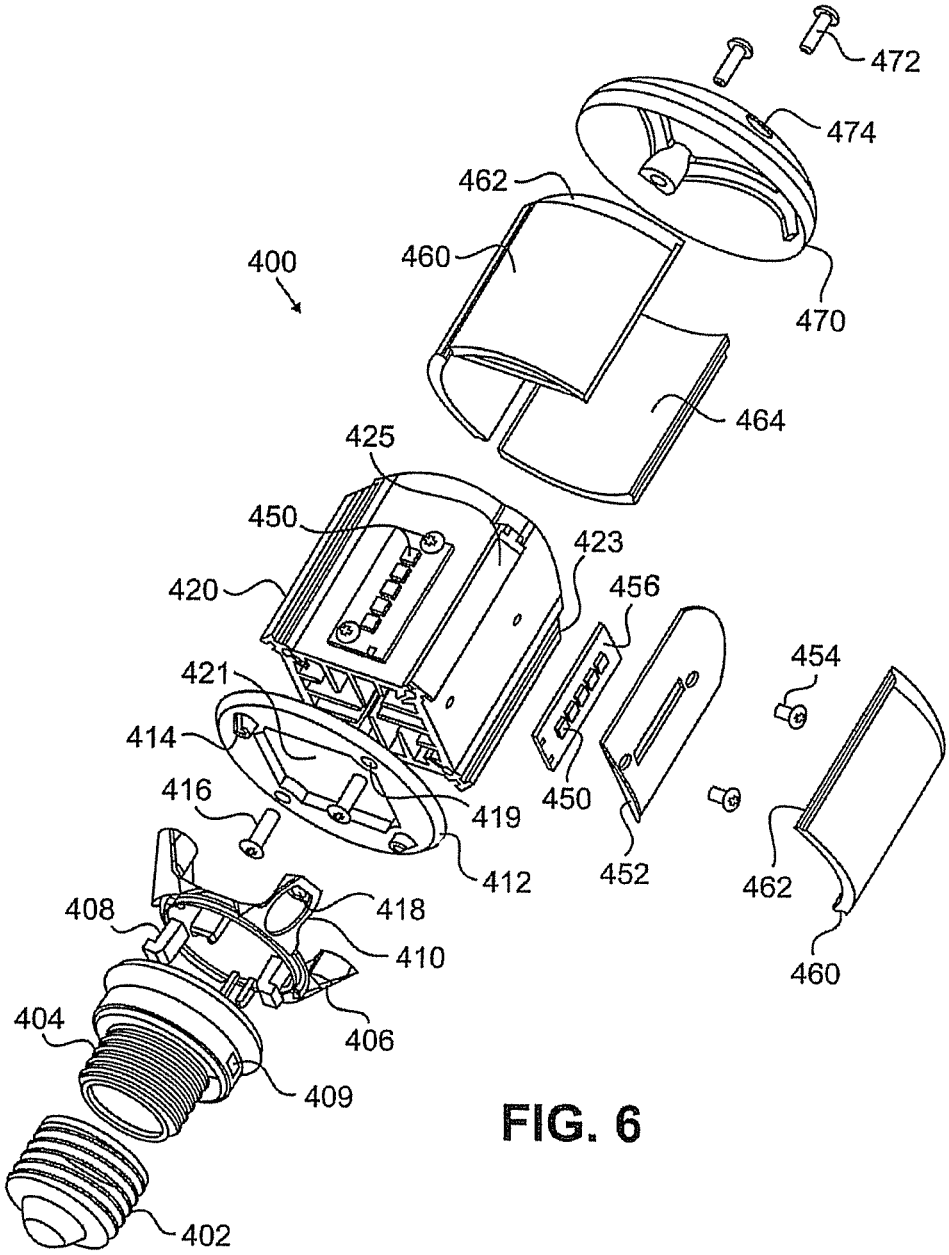
FIG. 6 is an exploded view of the compact solid state lamp of FIG. 4.

FIG. 6 shows an exploded view of the lamp 400 which comprises a screw shell 402 which fits onto a lower device housing 404. The lower device housing 404 houses drive circuitry for converting standard power, such as 120V line power provided in the United States to a voltage and current suitable for driving solid state lighting sources, such as LEDs. The particular configuration of the drive circuitry will depend on the configuration of the LEDs. In some embodiments, the drive circuitry comprises a power supply and drive controller that allows for separate control of at least two strings of LEDs, and in some embodiments, at least three strings of LEDs. Providing separate drive control can allow for adjusting string currents to tune the color point of the LEDs combined light output as described, for example, in commonly assigned United States Patent Publication No. 2009/0160363 entitled "Solid State Lighting Devices and Methods of Manufacturing the Same," the disclosure of which is incorporated herein as if set forth in its entirety. Alternatively, the drive circuitry may comprise a power supply and single string LED controller. Such an arrangement may reduce cost and size of the drive circuitry. In either case, the drive circuitry may also provide power factor correction. Thus, in some embodiments, lamp 400 may have a power factor of greater than 0.7 and in some embodiments a power factor of greater than 0.9. In some embodiments, the lamp 400 has a power factor of greater than 0.5. Such embodiments may not require power factor correction and, therefore, may be less costly and smaller in size. Additionally, the drive circuitry may provide for dimming of the lamp 400.

Lower device housing 404 also supports lower stand 406 which has four legs 408 which fit into housing 404 and which may snap into or interlock with a cutout or locking slot, such as cutout 409. Lower stand 406 also has four support and spacing arms 410 which support a lower base 412 above and spaced from the lower housing 404. This spacing helps allow for free airflow and helps provide thermal isolation between the drive circuitry and the LEDs.

Accordingly, a lamp as depicted in FIGS. 4-8 can comprise at least a first solid state light emitter (any of the LEDs 450), a power supply can be positioned inside the lower device housing 404 (i.e., inside the base of the lamp), the first solid state light emitter being mounted on the heat dissipation element 420, the power supply being electrically connected to the first solid state light emitter so that when line voltage is supplied to the power supply, the power supply feeds current to the first solid state light emitter, and the heat dissipation element 420 being spaced from the power supply. Referring to FIG. 5, well over 50 percent of the space defined by all points that are located between the heat dissipation element 420 and the base element (including the lower device housing 404), i.e., the region partially defined by the stand 406 is filled with an ambient medium, e.g., air. In this arrangement, at least some heat generated by the first solid state light emitter is dissipated by the heat dissipation element 420, and at least some heat generated by the power supply is dissipated from the lower device housing 404 which is spaced from the heat dissipation element. The heat dissipation element 420 comprises dissipation region sidewalls that define a heat dissipation chamber having and extending between inlet openings 430 and outlet openings (areas in the top opening 440 in which fins are not positioned).

The discussion herein of inlet and outlet openings is dependent on the orientation of the lamp. That is, the discussion of the embodiment depicted in FIGS. 4-8 relates to the lamp being oriented in an upright orientation, as shown in the Figures. In the event that the lamp is inverted (not necessarily axially oriented, but such that the openings 430 are higher than the opening 440), the openings 430 would become the outlet openings and the opening 440 would become the inlet opening, since warmer ambient medium rises.

The lower device housing 404, lower stand 406 and/or lower base 412 may be made of a thermoplastic, a polycarbonate, a ceramic, aluminum or other metal or another material may be utilized depending upon cost and design constraints. For example, the lower housing 404 may be made of a non-conductive thermoplastic to provide isolation of drive circuitry contained within the lower housing 404. The lower stand 406 may be made of an injection molded thermoplastic. The lower base 412 may be made of a thermoplastic. Alternatively, if the lower base 412 is to provide additional heat dissipation, the lower base 412 may be made of a metal, such as aluminum and thermally coupled to the heat sink 420, for example, using a thermal interface gasket.

Two extending guide members 414 align the lower base with and seat in two of the mounting arms 410. Two lower base screws 416 pass through respective openings 418 in arms 410, and openings 419 in lower base 412 to connectively mount a base portion of the lamp 400 comprising screw shell 402, lower driver housing 404, lower stand 406, and lower base 412 to an upper portion of lamp 400. Lower base 412 also comprises a large central opening 421. In conjunction with the spacing of the heat sink away from and above the power supply enclosure body, opening 421 allows air to freely flow through the opening 421 and the heat sink 420, as well as through top opening 440.

The upper portion of lamp 400 comprises the heat sink 420, four LED boards 450, reflector plates 452, LED board mounting screws 454, side lenses 460, top lens 470, and top lens screws 472. As described above, the reflector plates 452 and side lenses 460 may provide a mixing chamber in the cavity 455 in which the LEDs 450 are provided.

While not illustrated in the figures, to the extent that two components are to be thermally coupled together, thermal interface materials may also be provided. For example, at the interface between the circuit board on which the LEDs 450 are mounted and the heat sink 420, a thermal interface gasket or thermal grease may be used to improve the thermal connection between the two components.

As noted above, lower screws 416 attach the bottom portion of lamp 400 to the upper portion of lamp 400. As shown, they mate with the heat sink 420. The reflector plates 452 and screws 454 attach an LED board 455 on each of the four faces of the heat sink 420. Five LEDs 450 are shown on each board 455, and it is presently preferred in connection with the depicted embodiment that these LEDs be XPE-style LEDs from Cree, Incorporated. While these LEDs are presently preferred in this embodiment, other styles and brands may be suitably employed. The number of LEDs 450 can be changed by changing the number of LED boards 455, or by changing the number of LEDs 450 on any or all of the LED boards 455. In some embodiments, the number and types of LEDs are selected so that lamp 400 provides at least 600 lumens, in other embodiments, at least 750 lumens and in still further embodiments, at least 900 lumens. In other embodiments, the numbers and types of LEDs 450 are selected so that lamp 400 provides at least 1100 lumens. In some embodiments, the lumen output values are initial lumen output values (i.e. the amount of lumens being output before substantial lumen depreciation has occurred).

The LEDs 450 may be provided in a linear arrangement as shown in FIG. 6 or may be provided in other configurations. For example, a roughly circular, triangular or square array or even a single packaged device having one or more LEDs, such as an MC device from Cree, Inc., or as an array as described in commonly assigned U.S. patent application Ser. No. 12/475,261 (now U.S. Patent Publication No. 2009-0283779), entitled "Light Source with Near Field Mixing" filed May 29, 2009, the disclosure of which is incorporated herein as if set forth in its entirety, may be utilized. In a particular embodiment, 5 LEDs are provided with 3 blue shifted yellow (BSY) LEDs and 2 red LEDs where the LEDs are disposed alternating BSY and red LEDs. In some embodiments, the BSY LED has a color point that falls within a rectangle on the 1931 CIE Chromaticity diagram bounded by the x, y coordinates of 0.3920, 0.5164; 0.4219, 0.4960; 0.3496, 0.3675; and 0.3166, 0.3722. In some embodiments, the BSY LED has a color point that combines with a red LED to provide white light having a high CRI as described in U.S. Pat. No. 7,213,940, entitled "Lighting Device and Lighting Method," the disclosure of which is incorporated herein by reference as if set forth in its entirety.

Side lenses 460 have edges which snap or slidably fit into corresponding grooves 423 of corner mounts 425 of the heat sink 420. Top lens or cap 470 fits over the top edges 462 of side lenses 460 and top screws 472 pass through mounting openings 474 in the top lens 470 and mate with the heat sink 420. The embodiment shown may suitably employ extruded lenses with an injection molded top cap, but alternatively a single injection molded piece or cast component could replace these multiple pieces. The assembled lamp 400 is shown in FIGS. 4 and 5.

The optical design and geometry of the reflector plates 452, side lenses 460 and top lens or cap 470 may be adapted to provide light output over greater than a 180° hemisphere, for example, over a zone between 0° and 150° axially symmetric where the 180° hemisphere would be a zone between 0° and 90° axially symmetric, by several different approaches. One approach is to utilize phosphor converted warm white LEDs with a diffuser film or a layer at the lens interface to provide a wide angular dispersion of light and mix the light from the warm white LEDs. Another approach utilizes BSY and red LEDs as described in U.S. Pat. No. 7,213,940, in combination with a diffuser film or layer to provide warm white light across a wide angular distribution. A third approach uses blue LEDs driving a remote phosphor layer layered on and/or molded into the lens and/or provided as a separate structure from the lens. The remote phosphor generates light that appears white, either alone or in combination with the blue light from the LEDs. Furthermore, the phosphor layer may provide a wide angle of dispersion for the light as well as diffusing any blue light that passes through the phosphor layer. The phosphor layer may be a single or multiple phosphor layers combined. For example, a yellow phosphor, such as YAG or BOSE may be combined with a red phosphor to result in warm white light (e.g., a CCT of less than 4000K). Additionally, multiple remote phosphors, such as described in commonly assigned U.S. patent application Ser. No. 12/476,356 (now U.S. Patent Publication No. 2010/0301360), "Lighting Devices With Discrete Lumiphor-Bearing Regions On Remote Surfaces Thereof" filed Jun. 2, 2009, the disclosure of which is incorporated herein as if set forth in its entirety, either coated onto or molded into the lenses and cap could be utilized to provide warm white light across a wide angular distribution. An additional approach utilizes blue and red LEDs to drive a phosphor layer coated onto, molded into and/or provided separate from the lenses and cap to provide warm white light across a wide angular distribution.

The spacing of LEDs along most of the length of the upper portion of lamp 400 as shown in FIGS. 4 and 5, for example, provides for light emission along almost the entire body of the lamp. When a lamp, such as the lamp 400, is used in a decorative setting with a lamp shade or decorative glass fitting, undesirable shadows or hot spots may be advantageously reduced or avoided.

Figure 7A:
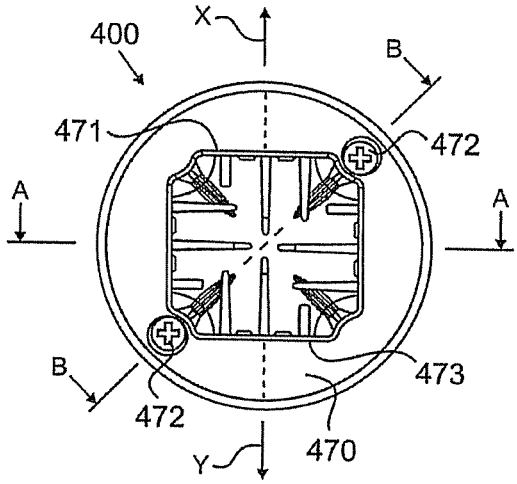
FIGS. 7A, 7B and 7C are bottom, side and top views of the compact solid state lamp of FIG. 4, respectively.
Figure 7B:
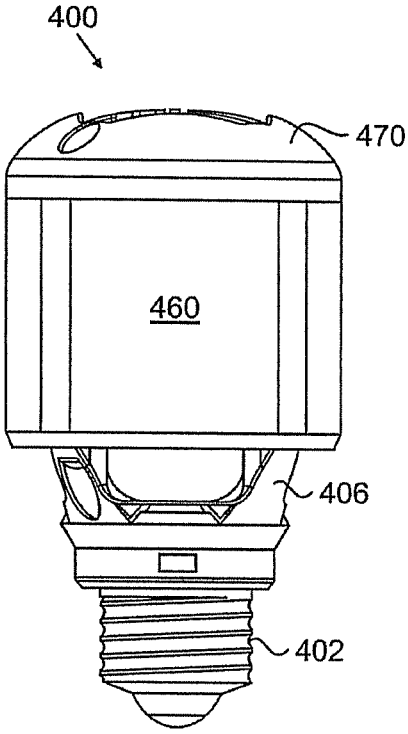
Figure 7C:
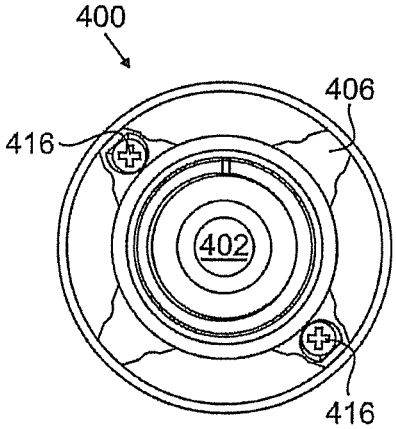
Figure 8A:
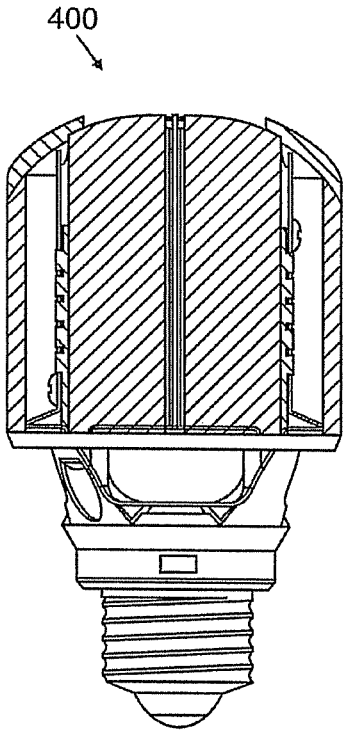
FIGS. 8A and 8B are cross-sectional views of the compact solid state lamp of FIG. 4 along section lines A-A and B-B of FIG. 7A, respectively.
Figure 8B:
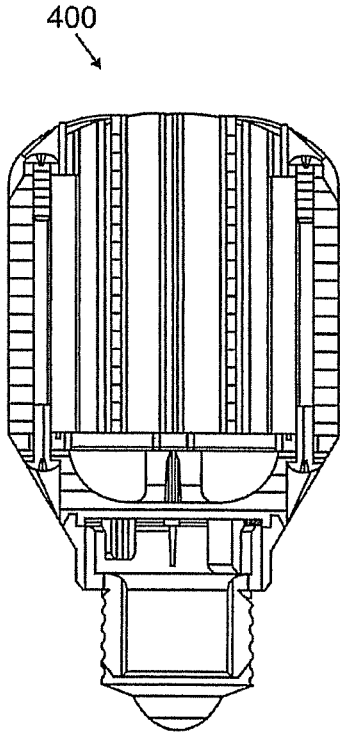

FIGS. 7A, 7B and 7C show top, side and bottom views of the lamp 400, and FIGS. 8A and 8B show cross-sectional views along lines A-A and B-B of FIG. 7A, respectively. As can be seen in FIG. 7A, LEDs 450 on top face 471 have a primary axis of light output X in a direction in which the LEDs on bottom face 473 direct no light, as their primary axis of light output Y is in the other direction.

Figure 9A:
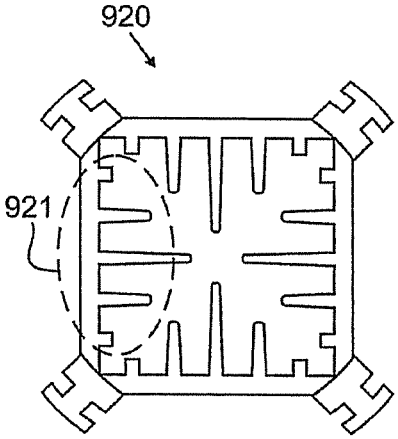
FIGS. 9A and 9B illustrate two alternative variations of heat sink fin configurations.
Figure 9B:
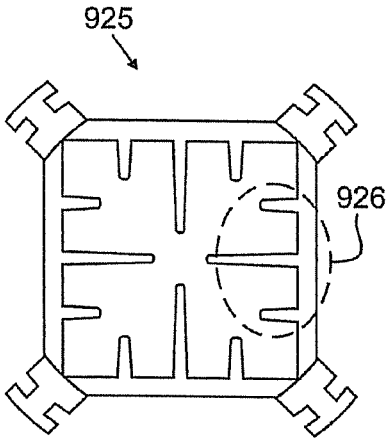
Figure 10:
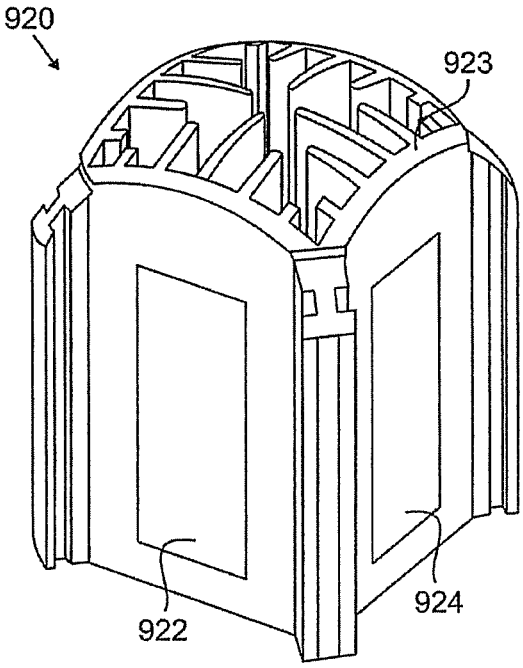
FIG. 10 is a perspective view of a heat sink having the fin configuration of FIG. 9A.

FIGS. 9A and 9B illustrate top views of two alternative heat sinks 920 and 925, respectively, with different fin arrangements. The heat sinks 920 and 925 may be manufactured in a number of ways, for example, by casting or extruding aluminum, or by injection molding or extruding thermally conductive plastic (e.g., if less heat dissipation is needed). The material, location and number of fins may be selected based on the application and wattage to be dissipated. The examples shown include 3 fins 926 or 5 fins 921 per face, although more or fewer fins may be used based upon the application. FIG. 10 shows a perspective view of the heat sink 920. In the perspective view of FIG. 10, the rectangular areas 922 simply indicate where LEDs would be mounted. The LEDs could be mounted as shown in FIG. 6 or using chip on heat sink mounting techniques, a multichip LED package, or standard LEDs soldered to a metal core printed circuit board (MCPCB), flex circuit or even a standard PCB, such as an FR4 board. For example, the LEDs could be mounted using substrate techniques such as from Thermastrate Ltd of Northumberland, UK. Top surfaces of heat sink 920, such as edges 923, may be machined or otherwise formed to match the dome shape of the standard A-lamp foot print to increase heat sink surface area.

Figure 11:
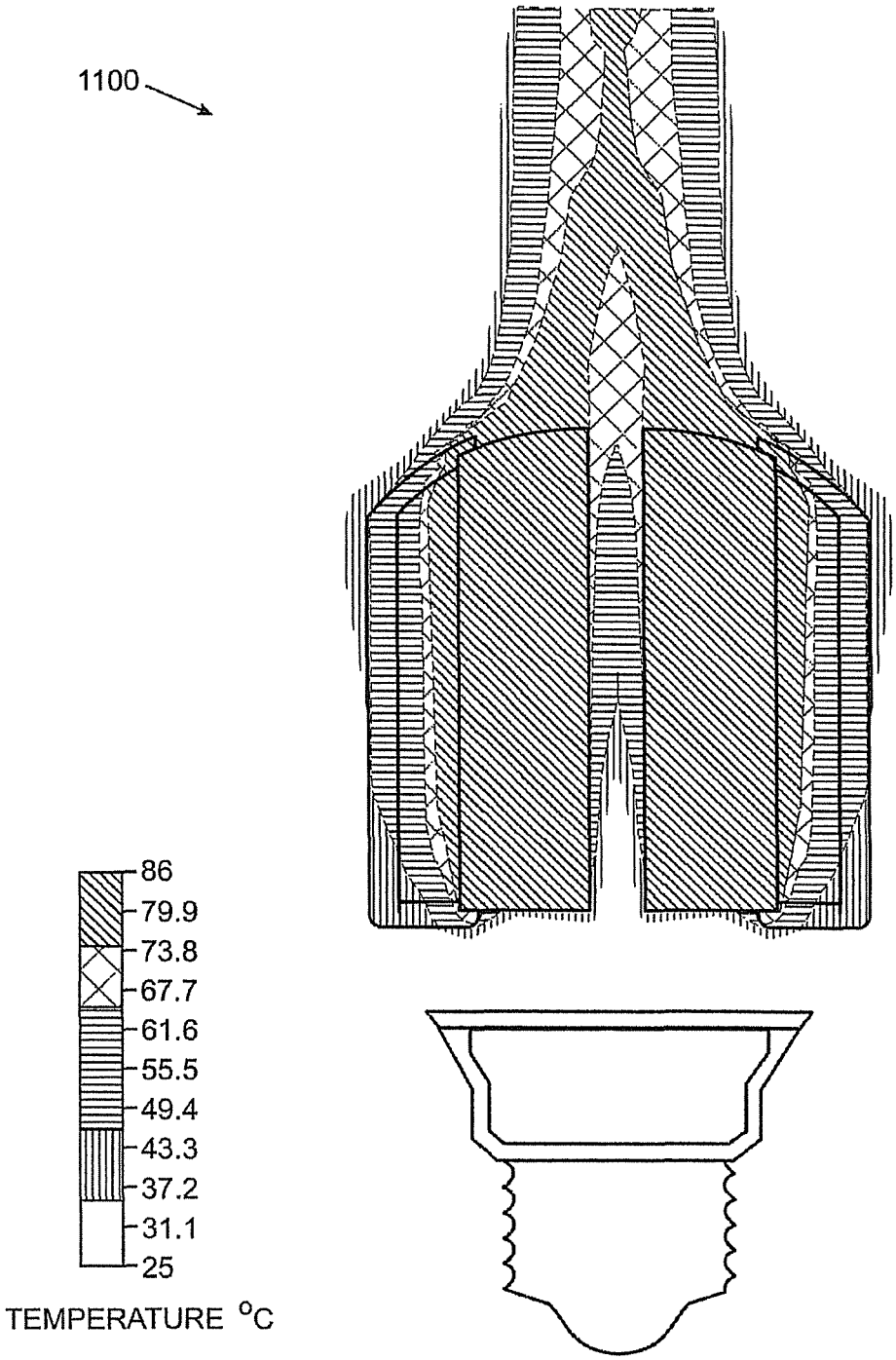
FIG. 11 is a thermal plot for a simulation of a solid state lamp employing a heat sink in accordance with the present inventive subject matter.

FIG. 11 shows a simulated thermal plot with a 9 W load, 2.25 W/face. The thermal plot demonstrates the functionality of the internal heat sink fins, keeping the heat sink change in temperature ($\Delta T$) from lamp off to steady state on to 50° to 60° C. for the 9 W load. This $\Delta T$ translates into a 60° to 75° C. rise in junction temperature. It should be noted that this simulation was run on a non-optimized fin structure like that shown in FIG. 9A, and improvements in geometry and performance should be expected as the design is optimized for specific applications/LED configurations.

Figure 12:
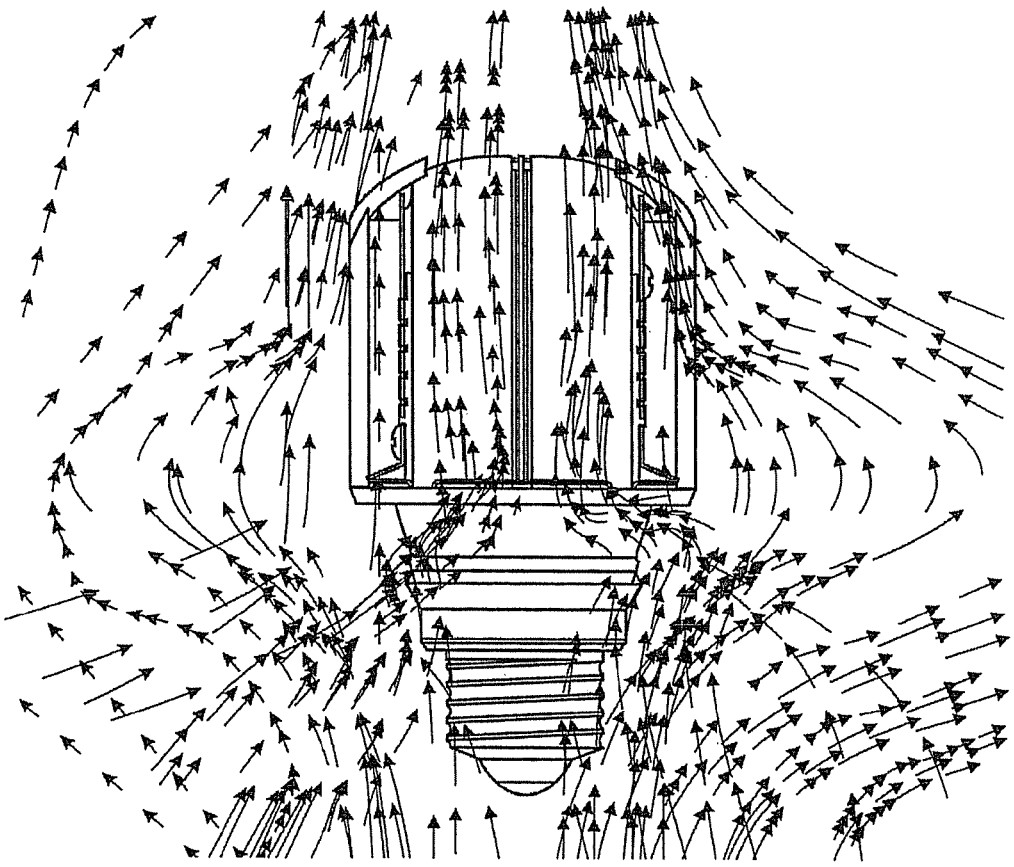
FIG. 12 is a flow-line plot for the simulation addressed by FIG. 11.

FIG. 12 shows a flow line plot 1100 from the same simulation as was addressed in connection with FIG. 11. The flow line plot 1100 demonstrates that the interior fin heat sink creates a chimney effect flow of air through the center of a lamp employing such a heat sink, like the lamp 400.

Figure 13:
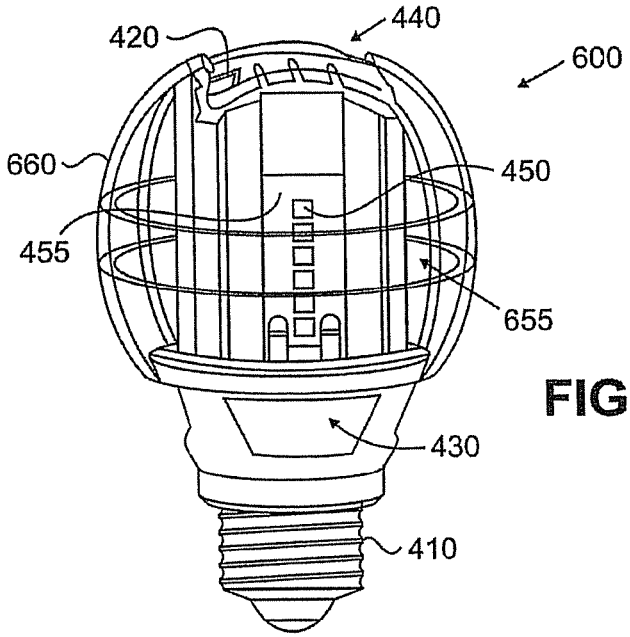
FIG. 13 is a view of portions of the exterior and portions of the interior of a solid state lamp according to some embodiments of the present inventive subject matter.
Figure 14:
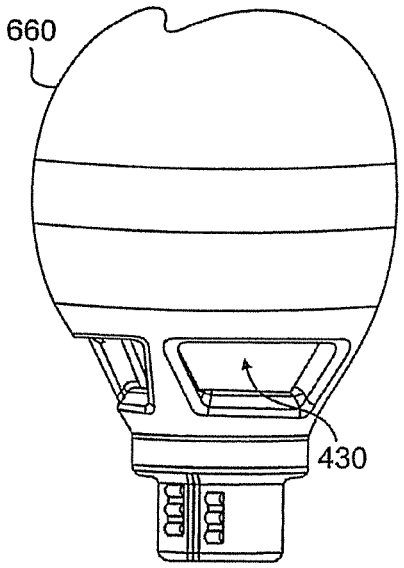
FIG. 14 is a front view of an exterior of the solid state lamp of FIG. 13.
Figure 15:
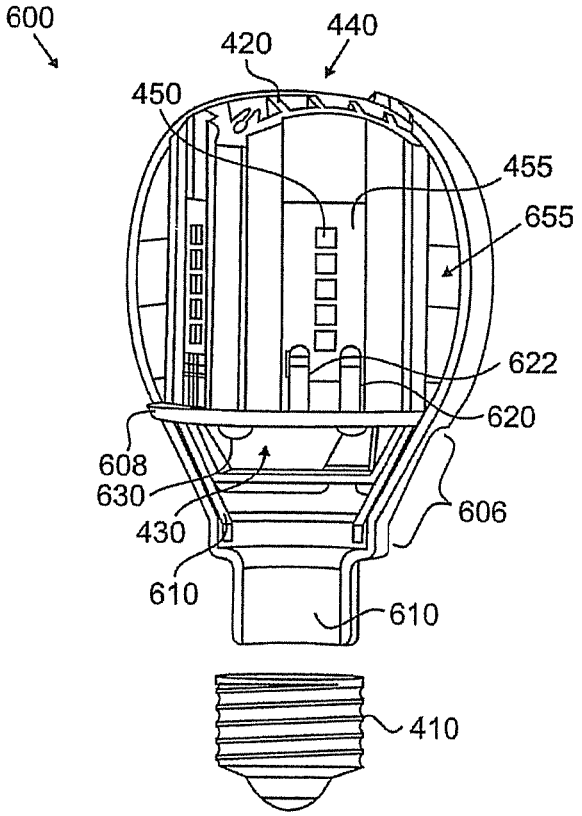
FIG. 15 is a cross-sectional view of the solid state lamp of FIG. 13.

FIGS. 13-15 illustrate a solid state lamp 600 according to further embodiments of the present inventive subject matter. As seen in FIGS. 13-15, the solid state lamp 600 includes the heat sink 420 and LED board 455 supporting LEDs 450 as described above. Optionally, the faces of the heat sink 420 on which the LED board 455 is mounted may be made flat to eliminate the angled portions at the corner of the heat sink 420 and allow light from different faces to be transmitted to portions of the lens 660 opposite a different face of the heat sink 420. The openings 420 and 430 allow for the flow of air through the heat sink 420. The solid state lamp 600, however, has an increased area of a mixing chamber 655 by providing a lens 660 that extends away from the LED board 450 while still fitting within the ANSI standard for a particular lamp, such as an A-lamp, as illustrated in FIGS. 13-15. By increasing the distance between the LEDs and the diffusive lens 660, the obscuration of the LEDs may be achieved with less diffusion and, therefore, less optical loss.

The lens 660 may be diffusive in that it may be made from a diffusing material or may include a diffuser film mounted on or near the lens 660. The lens 660 may be transmissive and reflective so that mixing occurs from a combination of reflection and refraction. The lens 660 may be thermo-formed, injection molded or otherwise shaped to provide the desired profile. Examples of suitable lens materials include diffusive materials from Bayer Material Science or SABIC. The lens 660 may be provided as a single structure or a composite of multiple structures. For example, the lens may be divided in half along a lateral line to allow insertion of the heat sink assembly into the lens and the second or "cap" portion of the lens attached. Furthermore, as illustrated in FIG. 15, the structure that provides the lens may also provide a housing 610 for the power supply as well as a stand 606 that spaces the heat sink 420 from the base to provide the openings 430.

The stand 606 may be made of one or more components. For example, as illustrated in FIG. 15, the stand 606 includes a base portion 608 on which the heat sink 420 is mounted. The stand 606 separates the heat sink 420 from the power supply housing 610 and may also provide electrical contacts 610 between the power supply (not shown) and the LED boards 450. As is further illustrated in FIG. 15, the base portion 608 may include friction connections 620 and 622 for electrically connecting to connector pads on the LED boards 450. The friction connections 620 and 622 may provide both electrical and mechanical connection of the heat sink assembly to the base portion 608. In such a way, the heat sink assembly including the heat sink 420 and the LED boards 450 may be assembled and tested and then inserted into the base portion without the need to solder electrical connections. The heat sink assembly may also be further fastened to the base portion 608 by additional mechanical fasteners, such as the screws 630 illustrated in FIG. 15.

While the heat sink 420 has been described herein as made as a single piece, such as a single extrusion, the heat sink may be made of multiple pieces. For example, each face could be an individual piece that is attached to other pieces to form the heat sink. Such an attachment may, for example, be provided by having mating surfaces of opposite polarity on each edge such that the mating surface of one face would slide into the mating surface of an adjacent face. Accordingly, the heat sink according to embodiments of the present inventive subject matter should not be construed as limited to a single unitized structure but may include heat sinks that are assembled from component parts.

Figure 16:
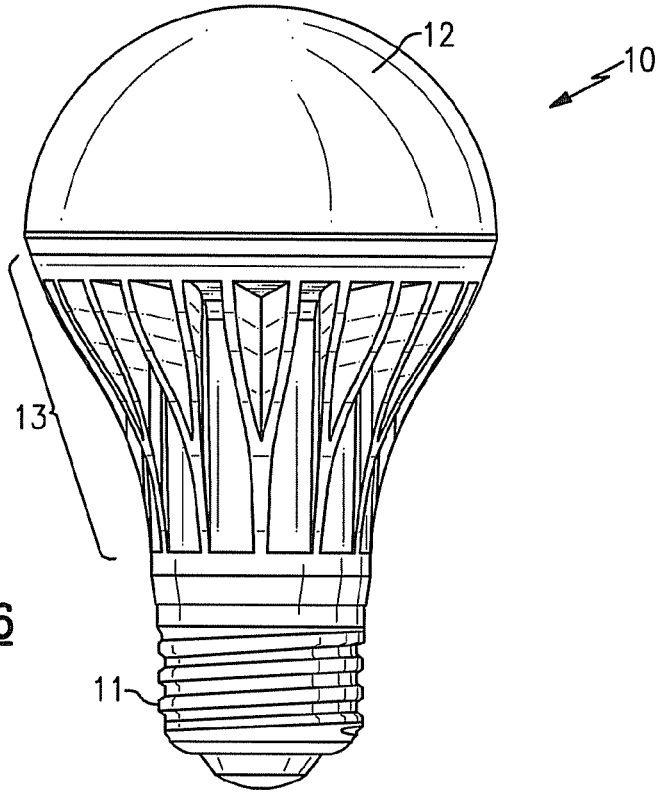
FIG. 16 illustrates another lamp in accordance with the present inventive subject matter.

FIG. 16 illustrates another lamp in accordance with the present inventive subject matter.

Referring to FIG. 16, the lamp 10 comprises a base 11 in the form of an Edison plug, an upper hemispherical region 12 and a middle region 13. The upper hemispherical region comprises a lens through which light emitted by a plurality of solid state light emitters positioned inside the lamp passes in order to exit the lamp. The exterior of the middle region 13 comprises a plurality of heat dissipation fins that are thermally coupled with the solid state light emitters.

Figure 17:
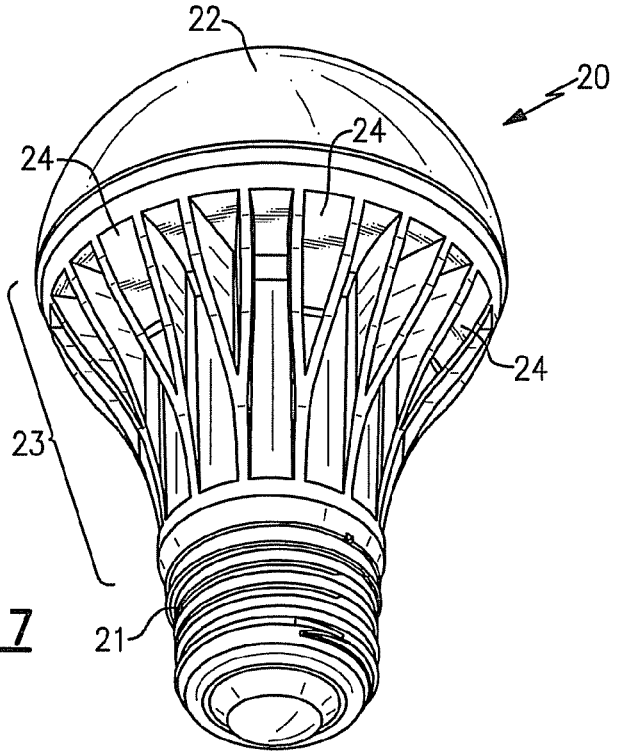
FIG. 17 illustrates another lamp in accordance with the present inventive subject matter.

FIG. 17 illustrates another lamp in accordance with the present inventive subject matter.

Referring to FIG. 17, similar to the lamp shown in FIG. 16, the lamp 20 comprises a base 21 in the form of an Edison plug, an upper hemispherical region 22 and a middle region 23. The upper hemispherical region comprises a cover through which light emitted by a plurality of solid state light emitters positioned inside the lamp passes in order to exit the lamp. The exterior of the middle region 23 comprises a plurality of heat dissipation fins that are thermally coupled with the solid state light emitters. Unlike the lamp shown in FIG. 16, the lamp shown in FIG. 17 includes transparent (or substantially transparent) lenses 24 positioned in half of the generally triangular regions between adjacent pairs of fins, (the regions being spaced, so that a lens is positioned in every other region between adjacent pairs of fins). Providing the lenses allows for light to spill out of the lamp through portions of the middle region 23 as well as through the upper region 22.

Figure 18:
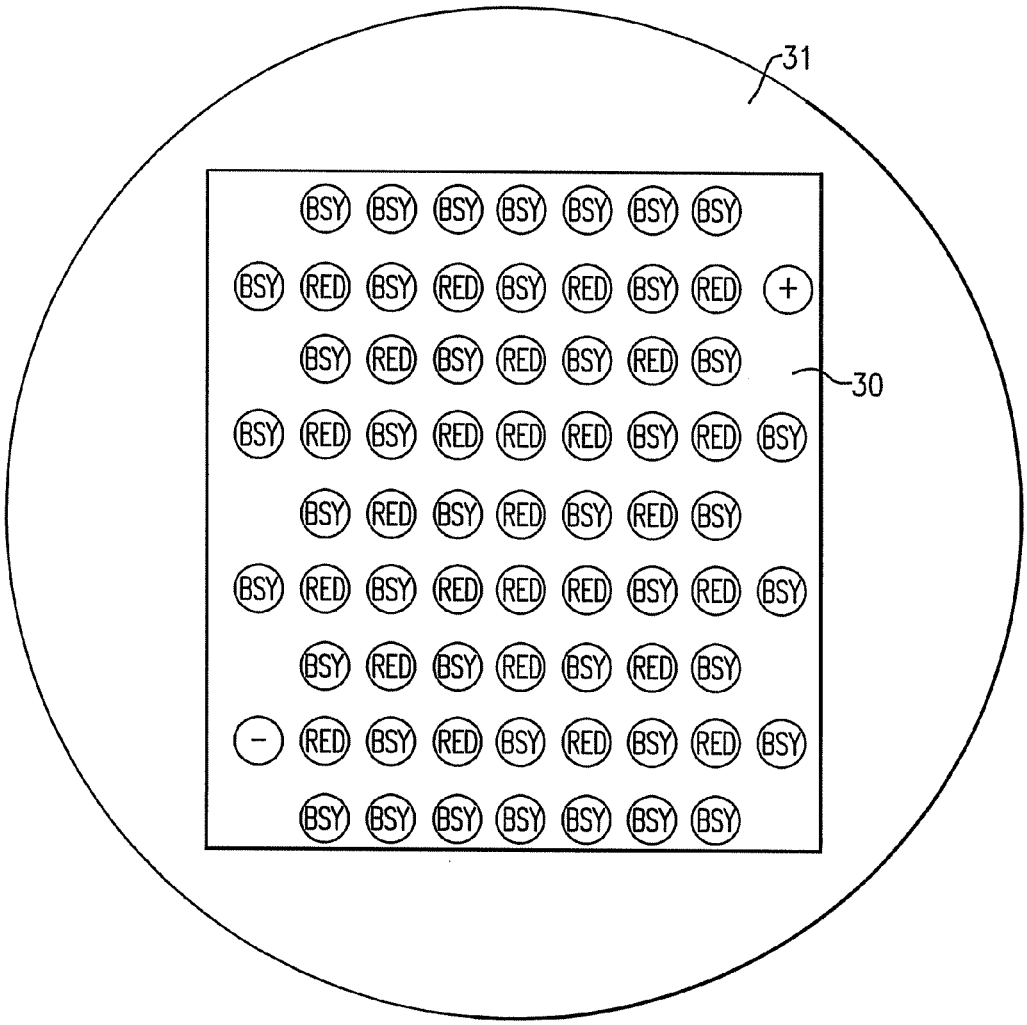
FIG. 18 illustrates a layout for solid state light emitters in the lamps depicted in FIGS. 16 and 17.

FIG. 18 shows a representative example of a layout for solid state light emitters in the lamps depicted in FIGS. 16 and 17. FIG. 18 shows a plurality of red LEDs and a plurality of BSY LEDs mounted on a printed circuit board 30 positioned on a circular disk 31. The circular disk 31 can be mounted inside lamps depicted in FIGS. 16 and 17, such that the plane of the circuit board 30 on which the LEDs are mounted will be substantially co-planar with the circular lower edge of the hemispherical lens, so that even high angle light emitted by the LEDs is incident upon the lens and is not blocked from exit by the middle region 23.

In the embodiments depicted in FIGS. 16 and 17, the lens can be made of any suitable light transmissive (or transparent) material, e.g., polycarbonate, and the middle region 23 can be made of any suitable heat conducting material, e.g., aluminum.

EXAMPLE 1

A heat sink arrangement as illustrated in FIGS. 13-15 was produced from aluminum. The dimensions of the heat sink were as described above. Ten Cree XP LEDs (6 BSY and 4 red) from the R2 and M2 brightness bins were mounted on a MCPCB which was then mounted to the heat sink. A thermal grease was placed between the MCPCB and the heat sink to improve the thermal connection between the MCPCB and the heat sink. The lower section without a power supply was also constructed as part of the lenses. The top outlet had a cross-sectional area of 30 mm×30 mm, minus the areas occupied by the fins. The bottom inlet had a cross-sectional area of about 864 square millimeters (four openings, each 24 mm×9 mm).

The above-described lamp was placed in an upright vertical orientation in a 25° C. ambient and driven with a remote power supply with 375 mA of current at 24.9 V initially and stabilized at 24.03 V after 40 minutes. The light output and electrical characteristics measured are summarized in Table 1 below (in which time is in minutes and "x" and "y" represent color coordinates, on a 1931 CIE Chromaticity Diagram, for the light output).

TABLE 1

| Time | Lumens | x | y | CCT | CRI | Volts | Watts |
|---|---|---|---|---|---|---|---|
| 0 | 905.5 | 0.459 | 0.4126 | 2726 | 92.3 | 24.93 | 9.35 |
| 10 | 805 | 0.4773 | 0.4146 | 2914 | 92.6 | 24.18 | 9.07 |
| 20 | 782 | 0.4445 | 0.4152 | 2963 | 92.3 | 24.07 | 9.03 |
| 30 | 775.4 | 0.4432 | 0.4154 | 2917 | 92.1 | 24.04 | 9.02 |
| 40 | 773.5 | 0.4434 | 0.4155 | 2983 | 92.1 | 24.03 | 9.01 |
| 50 | 772.8 | 0.4436 | 0.4159 | 2987 | 92.1 | 24.03 | 9.01 |
| 60 | 776.6 | 0.4434 | 0.4156 | 2984 | 92.1 | 24.03 | 9.01 |

These test results suggest a junction temperature ($T_j$) of 77° C. with a measured temperature ($T_c$) on the heat sink of 70° C. at 9 W DC input power. It is estimated that $T_j$ goes up by 8-10° C. for the lamp in the horizontal position.

EXAMPLE 2

Figure 19:
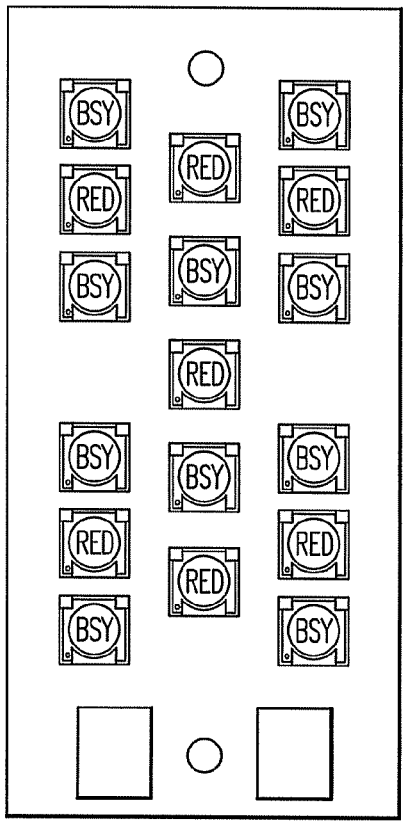
FIG. 19 depicts a layout for LEDs on the front and back sides of the embodiment described in Example 2.
Figure 20:
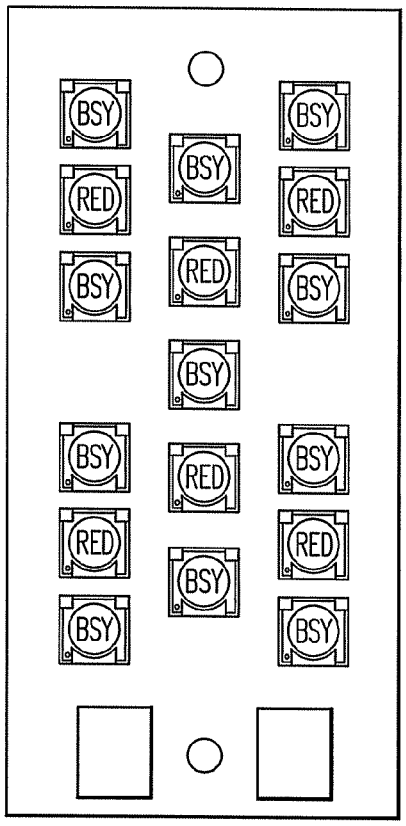
FIG. 20 depicts a layout for LEDs on the right and left sides of that embodiment.
Figure 21:
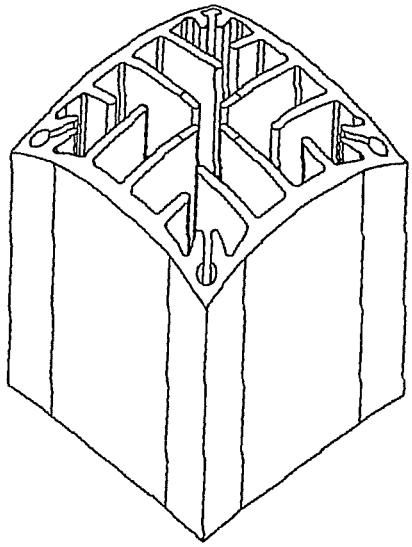
FIGS. 21 and 22 illustrate a heat sink fin configuration for the lamp of Example 2.
Figure 22:
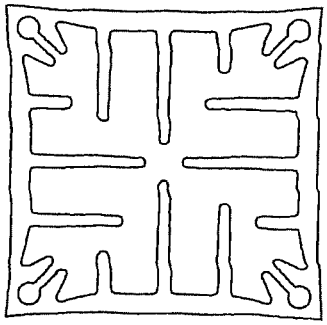

A heat sink arrangement substantially as illustrated in FIGS. 13-15 was produced from aluminum. The dimensions of the heat sink were substantially as described above, except that the heat sink (and its fins) were instead shaped as shown in FIGS. 21 and 22. In each of the four sides, seventeen Cree XP LEDs from the S2 and P3 brightness bins were mounted on a MCPCB which was then mounted to the heat sink. A thermal grease was placed between the MCPCB and the heat sink to improve the thermal connection between the MCPCB and the heat sink. The layout for the LEDs on the front and back sides is depicted in FIG. 19, and the layout for the LEDs on the right and left sides is depicted in FIG. 20. A somewhat larger MCPCB was used (in comparison to the one depicted in FIG. 6) to accommodate the larger number of LEDs. The lower section without a power supply was also constructed as part of the lenses. The top outlet had a cross-sectional area of 30 mm×30 mm, minus the areas occupied by the fins. The bottom inlet had a cross-sectional area of about 864 square millimeters (four openings, each 24 mm×9 mm). The power supply was a linear regulator (representative examples of high voltage linear regulators are described in U.S. patent application Ser. No. 11/626,483, filed Jan. 24, 2007 (now U.S. Patent Publication No. 2007/0171145), the entirety of which is hereby incorporated by reference as if set forth in its entirety.

The above-described lamp was placed in an upright (base down) vertical orientation in a 25° C. ambient and driven with a remote power supply. The light output and electrical characteristics measured are summarized in Table 2 below.

TABLE 2

| time (min) | Power (watts) | Lumens | CCT (K) | CRI | lumens per watt |
|---|---|---|---|---|---|
| 0 | 8.495 | 1015 | 2525 | 90.3 | 119.5 |
| 5 | 9.127 | 1030 | 2592 | 91.3 | 112.9 |
| 15 | 9.124 | 963 | 2688 | 91.4 | 105.5 |
| 30 | 9.145 | 943 | 2732 | 91.1 | 103.1 |
| 45 | 9.14 | 936.1 | 2743 | 91.2 | 102.4 |
| 60 | 9.126 | 936.2 | 2744 | 91.3 | 102.6 |

The unit reached thermal equilibrium in less than one hour.

EXAMPLE 3

The lamp described above in Example 2 was tested in a CALiPER approved Photometric Test Laboratory. The test was conducted with the lamp in an inverted vertical orientation (base up). The light output and electrical characteristics measured are summarized below:

| | | |
|---|---|---|
| total luminous flux | 977 | lumens |
| wall plug efficiency | 104.1 | lumens per watt |
| CCT | 2748K | |
| CRI | 91.2 | |
| Radiant flux | 3.09 | watts |
| Chroma x/chroma y | 0.4527/0.4039 | |
| Chroma u/chroma v | 0.2609/0.3491 | |
| input power | 9.389 | watts |
| input voltage (60 Hz) | 120.0 | V |
| input current | 195.3 | mA |
| power factor | 0.400 | |
| ambient T | 23.7 | degrees C. |
| stabilization tune | 44 | minutes |
| total operating time | 47 | minutes |

EXAMPLE 4

A lamp as described above with respect to FIG. 16, having fins and a housing made of aluminum, and a lens made of polycarbonate material, and employing Cree XP LEDs from the S2 and P3 brightness bins mounted on a MCPCB, and with a linear regulator as the power supply, was placed in an upright (base down) vertical orientation in a 25° C. ambient and driven with a remote power supply. The light output and electrical characteristics measured are summarized in Table 3 below.

TABLE 3

| time (min) | Power (watts) | Lumens | CCT (K) | CRI | lumens per watt |
|---|---|---|---|---|---|
| 0 | 8.613 | 1044 | 2570 | 91.1 | 121.2 |
| 5 | 8.897 | 1029 | 2626 | 91.5 | 115.7 |
| 15 | 8.898 | 980 | 2713 | 92.3 | 110.1 |
| 30 | 8.88 | 943 | 2766 | 91.8 | 106.2 |
| 45 | 8.88 | 932 | 2783 | 91.5 | 105.0 |
| 60 | 8.88 | 927 | 2791 | 92.6 | 104.4 |

EXAMPLE 5

The lamp described above in Example 4 was tested in a CALiPER approved Photometric Test Laboratory. The test was conducted with the lamp in an inverted vertical orientation (base up). The light output and electrical characteristics measured are summarized below:

| | | |
|---|---|---|
| total luminous flux | 969 | lumens |
| wall plug efficiency | 101.7 | lumens per watt |
| CCT | 2830K | |
| CRI | 90.9 | |
| Radiant flux | 3.03 | watts |
| Chroma x/chroma y | 0.4492/0.4075 | |
| Chroma u/chroma v | 0.2570/0.3497 | |
| input power | 9.532 | watts |
| input voltage (60 Hz) | 120.0 | V |
| input current | 197.9 | mA |
| power factor | 0.401 | |
| ambient T | 23.6 | degrees C. |
| stabilization time | 50 | minutes |
| total operating time | 52 | minutes |

Embodiments of the present inventive subject matter have been described with reference to a substantially square cross-sectional heat sink with four mounting faces. However, other configurations, such as triangular, pentagonal, octagonal or even circular could be provided. Furthermore, while the mounting surfaces are shown as flat, other shapes could be used. For example, the mounting surfaces could be convex or concave. Thus, a reference to a mounting face refers to location to and/or on which LEDs may be affixed and is not limited to a particular size or shape as the size and shape may vary, for example, depending on the LED configuration.

The lamps illustrated herein are illustrated with reference to cross-sectional drawings. These cross sections may be rotated around a central axis to provide lamps that are circular in nature. Alternatively, the cross sections may be replicated to form sides of a polygon, such as a square, rectangle, pentagon, hexagon or the like, to provide a lamp. Thus, in some embodiments, objects in a center of the cross-section may be surrounded, either completely or partially, by objects at the edges of the cross-section.

Furthermore, embodiments of the present inventive subject matter have been illustrated as enclosed structures having openings only at opposing ends. However, the structure of the heat sink need not make a complete enclosure. In such a case, an enclosure could be made by other components of the lamp in combination with the heat sink or a portion of the lamp structure could be left open.

Additionally, the specific configuration of components, such as the lower housing, may be varied while still falling within the teachings of the present inventive subject matter. For example, the number of legs in the lower housing may be increased or decreased from the four legs shown. Alternatively, the legs could be eliminated and a circular mesh or screen that allows air flow to the opening in the heat sink could be utilized. Similarly, the lower base 412 is shown as a disk with an opening corresponding to the heat sink opening, but the lower base 412 may also include openings corresponding to the mixing cavity 455 to allow light extraction at the base of the lamp. A corresponding lens could be provided at the opening in the lower base. Alternatively, the lower base could be made from a transparent or translucent material and function as a lower lens for the lamp 400.

While the present inventive subject matter has been disclosed in the context of various aspects of presently preferred embodiments including specific details relating to an A lamp replacement, it will be recognized that the inventive subject matter may be suitably applied to other lamps including different dimensions, materials, LEDs, and the like consistent with the claims which follow.

In the drawings and specification, there have been disclosed typical embodiments of the present inventive subject matter and, although specific terms are employed, they are used in a generic and descriptive sense only and not for purposes of limitation, the scope of the present inventive subject matter being set forth in the following claims.

Any two or more structural parts of the lamps or lighting devices described herein can be integrated. Any structural part of the lamps or lighting devices described herein can be provided in two or more parts (which may be held together in any known way, e.g., with adhesive, screws, bolts, rivets, staples, etc.).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lamp, comprising: at least a first solid state light emitter; at least a first heat dissipation element that comprises at least one dissipation region sidewall that defines at least one heat dissipation chamber; a power supply; and a power supply housing, the power supply in the power supply housing, the first solid state light emitter thermally coupled to the first heat dissipation element, the heat dissipation chamber having at least a first inlet opening and at least a first outlet opening, the lamp configured so that (1) an ambient medium enters the first inlet opening, and then passes through the heat dissipation chamber and exits the first outlet opening, and (2) an ambient medium can enters the first inlet opening and then enters the power supply housing without passing through the heat dissipation chamber.

2. A lamp comprising:

at least a first heat sink structure;

at least a first power supply element;

at least a first solid state light emitter;

at least a first base housing;

a plurality of arms; and a base, the first heat sink structure defining at least a first internal space, the first solid state light emitter on a first surface of the first heat sink structure that is opposite from a second surface of the first heat sink structure that faces the internal space, at least a portion of the first power supply element inside a space defined by the first base housing, at least portions of the arms extending from the first base housing to the base, the first heat sink structure supported on the base.

3. A lamp, comprising:

a first group of at least one light emitting diode that, if energized, emits BSY light; and a second group of at least one light emitting diode that, if energized, emits light that is not BSY light, the first and second groups of light emitting diodes are mounted on at least one circuit board, an average distance between a center of each light emitting diode in the first group and a closest point on an edge of the circuit board on which that light emitting diode is mounted is smaller than an average distance between a center of each light emitting diode in the second group and a closest point on an edge of the circuit board on which that light emitting diode is mounted, the lamp an A lamp and providing a wall plug efficiency of at least 90 lumens per watt.

4. A lamp as recited in claim 3, wherein the lamp emits at least 600 lumens when the lamp is energized.

5. A lamp as recited in claim 3, wherein the lamp further comprises a power line, and if line voltage is supplied to the power line, the lamp emits at least 600 lumens.

6. A lamp as recited in claim 3, wherein the lamp emits light having CRI Ra of at least 80 when the lamp is energized.

7. A lamp as recited in claim 3, wherein when the lamp is energized, a mixture of light emitted by the solid state light emitters in the lamp is within about 10 MacAdam ellipses of the blackbody locus on a 1931 CIE Chromaticity Diagram.

8. A lamp as recited in claim 3, wherein the at least one solid state light emitter that, if energized, emits light that is not BSY light emits light that has a dominant wavelength in the range of from about 600 nm to about 630 nm.

9. A lamp as recited in claim 3, wherein the lamp provides an expected L70 lifetime of at least 25,000 hours.

10. A lamp as recited in claim 3, wherein the lamp emits light in at least 50% of all directions extending from a center of the lamp.

11. A lamp as recited in claim 3, wherein the lamp comprises at least one heat dissipation chamber defined by at least one dissipation region sidewall, the chamber having at least a first inlet opening and at least a first outlet opening, whereby an ambient medium enters the first inlet opening, passes through the heat dissipation chamber and exits the first outlet opening, the first solid state light emitter thermally coupled to the dissipation region sidewall.

12. A lamp, comprising: at least one solid state light emitter; a first heat dissipation element; and at least a first group of inlets comprising a first inlet and a second inlet, the first heat dissipation element thermally coupled to said at least one solid state emitter, said first heat dissipation element comprising at least one heat dissipation chamber, said heat dissipation chamber comprising at least a first group of openings and a second group of openings, the first group of openings comprising at least one first group opening, the second group of openings comprising at least one second group opening, the lamp configured so that an ambient medium enters into a space beneath the first heat dissipation element through either of the first inlet and the second inlet, and then flows upward through the first group of openings into the heat dissipation chamber, then through the heat dissipation chamber, and then out through the second group of openings, a ratio of a cross-sectional area of the first group of inlets divided by a cross-sectional area of the second group of openings at least 0.90.

13. A lamp as recited in claim 12, wherein said solid state light emitter is mounted within a light transmissive housing, and said heat dissipation chamber passes through at least a portion of said light emissive housing.

14. A lamp as recited in claim 13, wherein said housing has multiple light emissive surfaces.

15. A lamp as recited in claim 12, wherein said solid state light emitter is mounted on said first heat dissipation element.

16. A lamp as recited in claim 13, wherein said heat dissipation chamber passes through at least a portion of said light emissive housing.

* * * * *

UNITED STATES PATENT AND TRADEMARK OFFICE

CERTIFICATE OF CORRECTION

PATENT NO. : 9,030,120 B2
APPLICATION NO. : 12/607355
DATED : May 12, 2015
INVENTOR(S) : Paul Kenneth Pickard, Gerald H. Negley and Antony Paul Van De Ven It is certified that error appears in the above-identified patent and that said Letters Patent is hereby corrected as shown below:

Title Page, Other Publications, Page 3, Right Column

Please change: "Ansi C78.20/2003, Revision of C78.20/1995, American National Standard for electric lamps- A, G, PS and Similar Shapes with E25 Medium Screw Basis, (Oct., 2003), pp. 1-48." to -- Ansi C78.20-2003, Revision of C78.20-1995, American National Standard for electric lamps- A, G, PS and Similar Shapes with E26 Medium Screw Basis, (Oct., 2003), pp. 1-48. --

Title Page, Other Publications, Page 3, Right Column

Please change: "EE Times, Pin-fin heat sink integrates fan, www.cetimes.com/showarticle.ihtml, (Nov. 2009), pp. 1-2, Dec. 2009." to -- EE Times, Pin-fin heat sink integrates fan, www.eetimes.com/showarticle.ihtml, (Nov. 2009), pp. 1-2, Dec. 2009. --

Title Page, Other Publications, Page 3, Right Column

Please change: "LED *PARFECTION*™, The Perfectly Designed Green Lighting Solution, http//www.litetronics.com/advertising/led-perfection-perfectly-designed.html, Aug. 2010." to -- LED *PARFECTION*™, The Perfectly Designed Green Lighting Solution, http//www.litetronics.com/advertising/led-parfection-perfectly-designed.html, Aug. 2010. --

Title Page, Other Publications, Page 3, Right Column

Please change: "Philips, *Philips First to Submit to Depamnent of Energy L PRIZE*$^{SM}$ *Competition with Development of LLED Replacment for Common Household Bulb,* Philips L PRIZE$^{SM}$Press Information, Sep. 24, 2009, pp. 1-3." to -- Philips, *Philips First to Submit to Department of Energy L PRIZE*$^{SM}$ *Competition with Development of LED Replacement for Common Household Bulb,* Philips L PRIZE$^{SM}$ Press Information, Sep. 24, 2009, pp. 1-3. --

Signed and Sealed this
Thirteenth Day of October, 2015

Michelle K. Lee

Michelle K. Lee
*Director of the United States Patent and Trademark Office*

Title Page, Other Publications, Page 3, Right Column

Please change: "By Nuventix, *SynJet® PAR20 LED Cooler with Heat Sink,* Design Guide, Version 1.0, Jul. 2009, pp. 1-33." to -- Nuventix, *Synjet® PAR20 LED Cooler with Heat Sink*, Design Guide, Version 1.0, Jul. 2009, pp. 1-33. --

Title Page, Other Publications, Page 3, Right Column

Please change: "Daniel Schlitz, *SBIR Phase I: Compact Heat Sink using Microscale Ion Driven Air Flow,* Science Storm, .K, sciencestorm.com/award/0340270.html, pp. 1-3, Dec. 2009." to -- Daniel Schlitz, *SBIR Phase I: Compact Heat Sink using Microscale Ion Driven Air Flow,* Science Storm, sciencestorm.com/award/0340270.html, pp. 1-3, Dec. 2009. --

Title Page, Other Publications, Page 3, Right Column

Please change: "THERMACORE, *Active Heat Sink Technology*, *AHST*, 2008, pp. 1. Press Release 08-041, Tiny Torrents, National Science Foundation, nsf.gov/news/news_surnm.jsp?cntn_id..., Mar. 17, 2008, pp. 1-3." to -- THERMACORE, *Active Heat Sink Technology*, *AHST*, 2008, pp. 1. Press Release 08-041, Tiny Torrents, National Science Foundation, nsf.gov/news/news_summ.jsp?cntn_id..., Mar. 17, 2008, pp. 1-3. --

Specification

Column 26, Lines 17-18

Please change: "U.S. patent application Ser. No. 12/469,819, filed on May 21, 2009 (now U.S. Patent Publication No. 2010/00102199)," to -- U.S. patent application Ser. No. 12/469,819, filed on May 21, 2009 (now U.S. Patent Publication No. 2010/0102199), --

Claims

Claim 1, Column 41, Line 26

Please change: "medium can enters the first inlet opening and then enters the" to -- medium enters the first inlet opening and then enters the --